US012466684B2

(12) United States Patent
Oguchi et al.

(10) Patent No.: US 12,466,684 B2
(45) Date of Patent: Nov. 11, 2025

(54) POST-PROCESSING DEVICE

(71) Applicant: SEIKO EPSON CORPORATION, Tokyo (JP)

(72) Inventors: Takeru Oguchi, Chino (JP); Masaki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 178 days.

(21) Appl. No.: 18/064,788

(22) Filed: Dec. 12, 2022

(65) Prior Publication Data

US 2023/0183032 A1 Jun. 15, 2023

(30) Foreign Application Priority Data

Dec. 13, 2021 (JP) ..... 2021-201475

(51) Int. Cl.
*B65H 31/36* (2006.01)
*B65H 3/02* (2006.01)
(Continued)

(52) U.S. Cl.
CPC ..... *B65H 31/36* (2013.01); *B65H 3/02* (2013.01); *B65H 7/20* (2013.01); *B65H 9/004* (2013.01); *B65H 9/08* (2013.01); *B65H 9/103* (2013.01); *B65H 29/20* (2013.01); *B65H 31/02* (2013.01); *B65H 31/26* (2013.01); *B65H 43/04* (2013.01); *B65H 2404/1114* (2013.01); *B65H 2404/5311* (2013.01); *B65H 2404/72* (2013.01); *B65H 2513/50* (2013.01); *B65H 2515/10* (2013.01); *B65H 2515/34* (2013.01); *B65H 2801/03* (2013.01); *B65H 2801/27* (2013.01)

(58) Field of Classification Search
CPC . B65H 9/004; B65H 9/08; B65H 9/10; B65H 9/103; B65H 31/02; B65H 31/26; B65H 31/34; B65H 31/36; B65H 3/02; B65H 7/20; B65H 29/20; B65H 2301/4212; B65H 2301/4213; B65H 2404/1114; B65H 2404/5311; B65H 2404/67; B65H 2404/72; B65H 2513/50; B65H 2515/34; B65H 2511/15; B65H 2511/212; B65H 2511/30; B65H 2801/03; B65H 2801/27
See application file for complete search history.

(56) References Cited

U.S. PATENT DOCUMENTS 5,026,034 A * 6/1991 Russel ..... B65H 31/26 271/211
8,899,579 B2 * 12/2014 Gamo ..... B65H 31/34 271/220

(Continued)

FOREIGN PATENT DOCUMENTS

JP 2018-188237 A 11/2018
JP 2020-050510 A 4/2020

*Primary Examiner* — Prasad V Gokhale
(74) *Attorney, Agent, or Firm* — WORKMAN NYDEGGER

(57) ABSTRACT

A transport unit transports a transport medium after the transport medium is newly placed as an uppermost medium in a state in which one or a plurality of placed media are already placed in a processing tray. At this state, at least one of the placed media placed on the processing tray is pressed by a pressing unit at a pressing position. After the transport unit is separated away from the transport medium, the pressing unit can move from the pressing position to a retraction position.

12 Claims, 10 Drawing Sheets

(51) Int. Cl.

| | |
|---|---|
| ***B65H 7/20*** | (2006.01) |
| ***B65H 9/00*** | (2006.01) |
| ***B65H 9/08*** | (2006.01) |
| ***B65H 9/10*** | (2006.01) |
| ***B65H 29/20*** | (2006.01) |
| ***B65H 31/02*** | (2006.01) |
| ***B65H 31/26*** | (2006.01) |
| ***B65H 43/04*** | (2006.01) |

(56) References Cited

U.S. PATENT DOCUMENTS

| | | | | |
|---|---|---|---|---|
| 2018/0312363 | A1 | 11/2018 | Noso et al. | |
| 2020/0101768 | A1* | 4/2020 | Kondo | B65H 31/02 |
| 2021/0155020 | A1* | 5/2021 | Amano | B42C 1/12 |

* cited by examiner

TA

| MEDIUM TYPE | CONTROL TYPE | REFERENCE NUMBER OF MEDIA |
|---|---|---|
| MEDIUM TYPE MA | FIRST ALIGNMENT/ SECOND ALIGNMENT | FIRST NUMBER S1 |
| MEDIUM TYPE MB | FIRST ALIGNMENT/ SECOND ALIGNMENT | SECOND NUMBER S2 |
| MEDIUM TYPE MC | FIRST ALIGNMENT | FIRST CONTROL INFORMATION |
| MEDIUM TYPE MD | SECOND ALIGNMENT | SECOND CONTROL INFORMATION |
| ・・・ | ・・・ | ・・・ |

POST-PROCESSING DEVICE

The present application is based on, and claims priority from JP Application Serial Number 2021-201475, filed Dec. 13, 2021, the disclosure of which is hereby incorporated by reference herein in its entirety.

BACKGROUND

1. Technical Field

The present disclosure relates to a post-processing device that aligns a downstream end of a medium in a transport direction by transporting the medium placed on a processing tray.

2. Related Art

For example, JP-A-2018-188237 discloses a post-processing device including a processing tray in which a medium after recording can be placed, a transport unit capable of transporting the medium, which is placed on the processing tray, in a transport direction, and an alignment unit that aligns a downstream end, in the transport direction, of the medium.

In such a post-processing device, the transport unit rotates while being brought into contact with an uppermost medium placed on the processing tray, and thus the uppermost medium is transported in the transport direction. As a result, a downstream end of the uppermost medium in the transport direction is caused to abut against the alignment unit. With this, the post-processing device is capable of aligning the downstream end, in the transport direction, of the medium, which is placed on the processing tray. In particular, for example, as in JP-A-2018-188237, the transport unit including a paddle blade with high friction is adopted, and thus a transport force for transporting the medium in the transport direction can be increased.

However, when, in such a post-processing device, a transport medium that is newly placed on the processing tray is transported by the transport unit in the transport direction in a state in which a placed medium is already placed on the processing tray, alignment deviation is caused in some cases at the time of separating the transport unit away from the transport medium.

SUMMARY

In order to solve the above-mentioned problem, a post-processing device includes a processing tray configured to place a medium after recording thereon, a transport unit configured to transport, in a transport direction, an upper most medium placed on the processing tray by contacting with an upper surface of the upper most medium placed on the processing tray, an alignment unit configured to align a downstream end, in the transport direction, of the medium placed on the processing tray, a pressing unit configured to press, against the processing tray, the medium placed on the processing tray, and a control unit configured to control an operation of the pressing unit, wherein the pressing unit is configured to move between a pressing position at which the medium placed on the processing tray is pressed and a retraction position at which pressing on the medium placed on the processing tray is released, the control unit is configured to, when the transport unit transports a transport medium after the transport medium is newly placed as an uppermost medium in a state in which one or a plurality of placed media are already placed on the processing tray, cause the pressing unit at the pressing position to press at least one of the placed media placed on the processing tray, and the control unit is configured to, after the transport unit is separated away from the transport medium, move the pressing unit from the pressing position to the retraction position.

DESCRIPTION OF EXEMPLARY EMBODIMENTS

First Exemplary Embodiment

Hereinafter, an exemplary embodiment of a recording system including a post-processing device is described. The recording system performs, for example, a recording operation in which recording is performed on a medium and a post-processing operation in which post-processing is performed on the medium on which recording has been performed.

Configuration of Recording System

Figure 1:
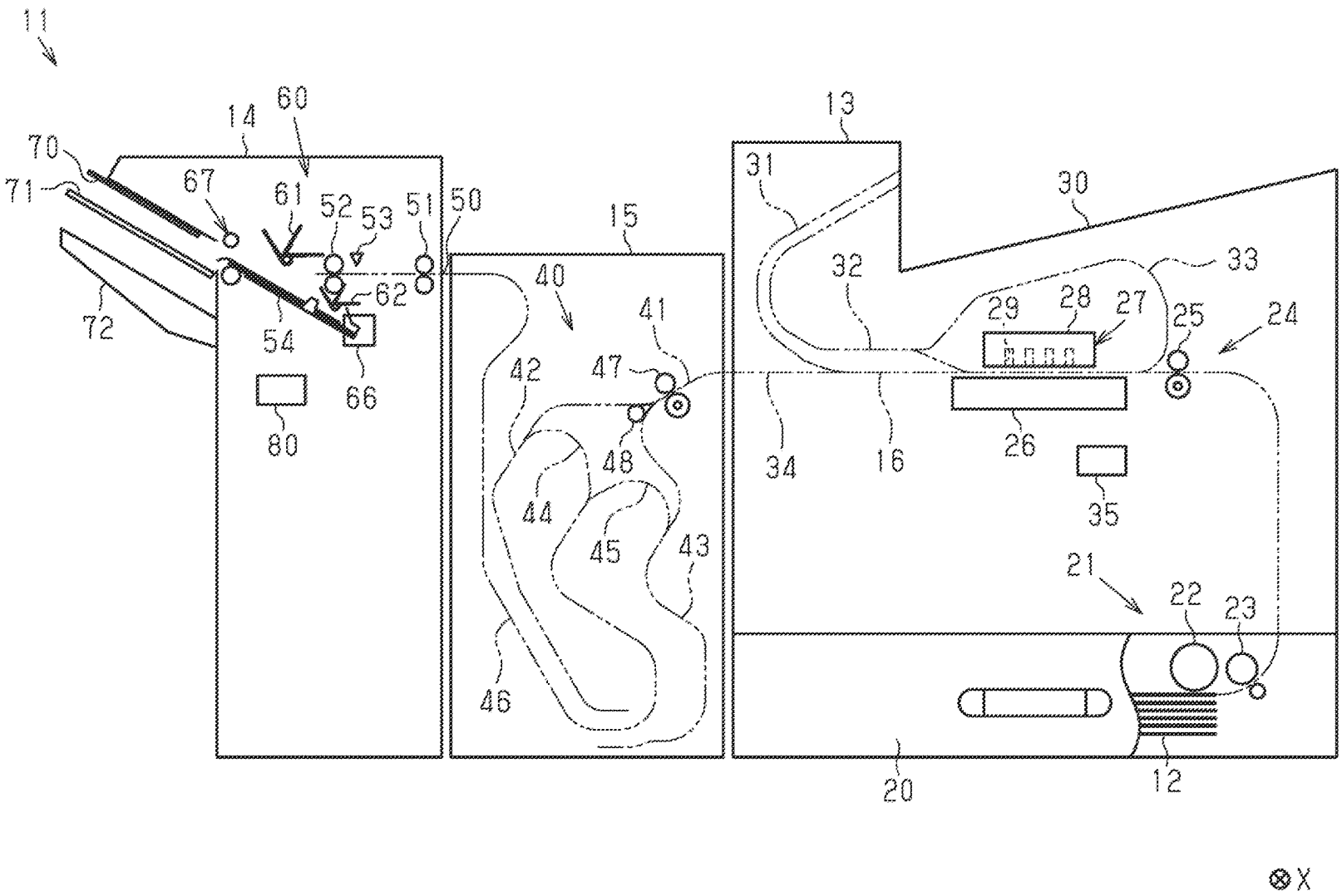
FIG. 1 is a side view schematically illustrating a recording system including a post-processing device.

As illustrated in FIG. 1, a recording system 11 includes a recording device 13 that performs recording on a medium 12. The recording system 11 includes a post-processing device 14. The post-processing device 14 performs post-processing on the medium 12 on which recording is performed by the recording device 13. The recording system 11 may include an intermediate device 15. The intermediate device 15 is arranged between the recording device 13 and the post-processing device 14. The intermediate device 15 transports the medium 12, on which recording is performed by the recording device 13, to the post-processing device 14.

The recording system 11 includes a transport path 16. The transport path 16 is a path that continues from the recording device 13 to the inside of the post-processing device 14 via the intermediate device 15. The recording system 11 includes a plurality of transport roller pairs. The plurality of transport roller pairs transport the medium 12 along the transport path 16. For example, at least one or more transport roller pairs are provided at each of the recording device 13, the intermediate device 15, and the post-processing device 14. In the present exemplary embodiment, the width direction of the medium 12 is indicated by a width direction X. Further, in the present exemplary embodiment, for easy understanding of the present disclosure, illustration is given in a state in which an interval between the media 12 is sufficiently large.

Configuration of Recording Device 13

The recording device 13 is configured to perform recording on the medium 12. The recording device 13 of the present exemplary embodiment is an ink-jet type printer, but may be a laser type printer. The ink-jet type printer is a printer that records an image on the medium 12 by ejecting ink, which is an example of a liquid, onto the medium 12. The laser type printer is a printer that records an image on the medium 12 by causing a toner to adhere onto the medium 12 through use of laser light. Examples of the image include photographs, patterns, letters, symbols, marks, lines, and tables.

The recording device 13 includes a cassette 20. The cassette 20 accommodates the medium 12 in a stacked state. The cassette 20 is removably provided in the recording device 13. A plurality of cassettes 20 may be provided.

The recording device 13 includes a paper feed mechanism 21. The paper feed mechanism 21 is configured to feed the medium 12 to a recording unit 27. The paper feed mechanism 21 sends out the medium 12 accommodated in the cassette 20 to the transport path 16. The paper feed mechanism 21 may include a pickup roller 22 and a separation roller 23. The pickup roller 22 sends out the uppermost medium 12 of the media 12 accommodated in the cassette 20. The separation roller 23 separates the media 12 from each other, the media 12 being sent out from the pickup roller 22.

The recording device 13 includes a transport mechanism 24. The transport mechanism 24 transports the medium 12 fed by the paper feed mechanism 21, along the transport path 16. The transport mechanism 24 is configured to transport the medium 12 on which recording is performed by the recording unit 27. The transport mechanism 24 includes a plurality of first transport roller pairs 25. The plurality of first transport roller pairs 25 are transport roller pairs provided in the recording device 13. The plurality of first transport roller pairs 25 are arranged along the transport path 16. In FIG. 1, one of the plurality of first transport roller pairs 25 is illustrated in a representative manner. The plurality of first transport roller pairs 25 transport the medium 12 sent out from the cassette 20, along the transport path 16 in the recording device 13.

The recording device 13 includes a support unit 26. The support unit 26 is provided at a position along the transport path 16. The support unit 26 supports the medium 12.

The recording device 13 includes the recording unit 27. The recording unit 27 is configured to perform recording on the medium 12. The recording unit 27 is provided at a position facing the support unit 26 with the transport path 16 interposed therebetween. The recording unit 27 includes a liquid ejection head 28. The liquid ejection head 28 includes a plurality of nozzles 29 that eject a liquid. The liquid ejection head 28 performs recording on the medium 12 by ejecting the liquid from the plurality of nozzles 29 onto the medium 12 supported by the support unit 26.

For example, the liquid ejection head 28 of the present exemplary embodiment is a line head that includes the plurality of nozzles 29 arrayed in a constant pitch in the width direction X and is capable of simultaneously ejecting the liquid along the width of the medium 12. Note that the liquid ejection head 28 may be a serial head that is mounted at a carriage reciprocable in the width direction X and ejects the liquid from the plurality of nozzles 29 while moving together with the carriage.

The recording device 13 includes a placement tray 30. The medium 12 discharged from the inside of the recording device 13 is placed at the placement tray 30. The recording device 13 has a first discharge path 31, a switch back path 32, an inversion path 33, and a second discharge path 34 as part of the transport path 16. The first discharge path 31 is a path through which the medium 12 is discharged. The medium 12 discharged from the first discharge path 31 is placed at the placement tray 30. The switch back path 32 is a path through which the medium 12 is switched back. The inversion path 33 is a path through which the front and back of the medium 12 are inverted. The second discharge path 34 is a path through which the medium 12 is discharged. The medium 12 discharged from the second discharge path 34 is transported to the intermediate device 15. In this way, the medium 12 on which recording is performed by the liquid ejection head 28 is discharged to the placement tray 30 through the first discharge path 31, or is transported through the second discharge path 34 toward the intermediate device 15.

When double-sided recording is performed, the medium 12 on which recording is performed on one side is transported to the switch back path 32 and then switched back in the switch back path 32. Thus, the medium 12 on which recording is performed on one side is transported from the switch back path 32 to the inversion path 33. The medium 12 inverted in the inversion path 33 is again transported to the liquid ejection head 28, and then recording is performed on a surface opposite to the surface on which recording is previously performed by the liquid ejection head 28. In this way, the recording device 13 performs the double-sided recording on the medium 12.

The recording device 13 includes a recording control unit 35. The recording control unit 35 may comprehensively control driving of each mechanism in the recording device 13 and may control various operations performed in the recording device 13. The recording control unit 35 may include one or more processors that perform various processes according to a computer program, one or more dedicated hardware circuits, such as an application-specific integrated circuit, that performs at least some of the various processes, or a combination thereof. The processor includes a CPU and a memory. The memory is a RAM, a ROM, or the like, and stores a program code or a command configured to cause the CPU to execute the processing. The memory, that is, a computer readable medium includes all kinds of readable media accessible by a general purpose or dedicated computer.

The recording control unit 35 is capable of communicating with the intermediate device 15 via a communication unit (not illustrated). The recording control unit 35 is capable of communicating with the post-processing device 14 via a communication unit (not illustrated). In the present exemplary embodiment, the recording control unit 35 is capable of transmitting post-processing information relating to post-processing to the post-processing device 14 when a recording command involving the post-processing is input.

The post-processing information contains medium type information. The medium type information is information with which a type of the medium 12 after recording is performed thereon by the recording unit 27 can be specified. The post-processing information contains information relating to the number of media to be processed. The information relating to the number of media to be processed is information with which the number of processed media subjected to the post-processing can be specified. The number of media to be processed is the number of media per unit for which the post-processing is executed. In this way, the recording control unit 35 is configured to perform control regarding at least recording on the medium 12.

Configuration of Intermediate Device 15

The intermediate device 15 is a device for discharging the medium 12 after recording that is carried in from the recording device 13, to the post-processing device 14. The intermediate device 15 may include an inversion processing unit 40. The inversion processing unit 40 inverts the carried-in medium 12.

The inversion processing unit 40 may have a first introduction path 41, a first switch back path 42, a second switch back path 43, a first joining path 44, a second joining path 45, and a lead-out path 46 as part of the transport path 16.

The inversion processing unit 40 may include a plurality of second transport roller pairs 47. The plurality of second transport roller pairs 47 are transport roller pairs provided in the intermediate device 15. The plurality of second transport roller pairs 47 are arranged along the transport path 16. In FIG. 1, one of the plurality of second transport roller pairs 47 is illustrated in a representative manner.

The inversion processing unit 40 may include a flap 48. The flap 48 guides the medium 12 to any one of the first switch back path 42 and the second switch back path 43 at a branch location at which the first introduction path 41 branches to the first switch back path 42 and the second switch back path 43. In this manner, the flap 48 switches a transport destination of the medium 12 transported from the first introduction path 41 between the first switch back path 42 and the second switch back path 43.

The medium 12 transported to the first switch back path 42 is inverted in the first joining path 44 by being switched back in the first switch back path 42 and is then transported to the lead-out path 46. On the other hand, the medium 12 transported from the first introduction path 41 to the second switch back path 43 is inverted in the second joining path 45 by being switched back in the second switch back path 43, and is then transported to the lead-out path 46. The intermediate device 15 can cause the medium 12 to be alternately carried into the first switch back path 42 and the second switch back path 43, for example.

Configuration of Post-Processing Device 14

The post-processing device 14 is a device that performs post-processing on the medium 12 after recording that is carried in from the intermediate device 15. In other words, the post-processing device 14 is configured so as to receive the medium 12 on which recording has been performed by the recording device 13 and to perform the post-processing on the received medium 12.

The post-processing device 14 includes a reception unit 50. The reception unit 50 is provided in the transport path 16. The reception unit 50 is configured to receive the medium 12 carried in from the intermediate device 15. In this way, the reception unit 50 can receive the medium 12 on which recording is performed by the recording device 13.

The post-processing device 14 may include a third transport roller pair 51. The third transport roller pair 51 is a transport roller pair provided in the post-processing device 14. The third transport roller pair 51 is arranged along the transport path 16. The third transport roller pair 51 is configured to transport the medium 12 after recording that is received by the reception unit 50.

The post-processing device 14 may include a fourth transport roller pair 52. The fourth transport roller pair 52 is a transport roller pair provided in the post-processing device 14. The fourth transport roller pair 52 is provided at a terminal end of the transport path 16.

The post-processing device 14 includes a sensor 53. The sensor 53 is arranged between the third transport roller pair 51 and the fourth transport roller pair 52 along the transport path 16. In other words, the sensor 53 is arranged upstream of the fourth transport roller pair 52. The sensor 53 detects a leading end and a trailing end of the carried-in medium 12.

In the present exemplary embodiment, the post-processing device 14 transports the medium 12 at a predetermined transport speed in the transport path 16 inside the post-processing device 14. In the present embodiment, when the trailing end of the medium 12 passes through the fourth transport roller pair 52, the medium 12 falls down from the fourth transport roller pair 52.

Figure 2:
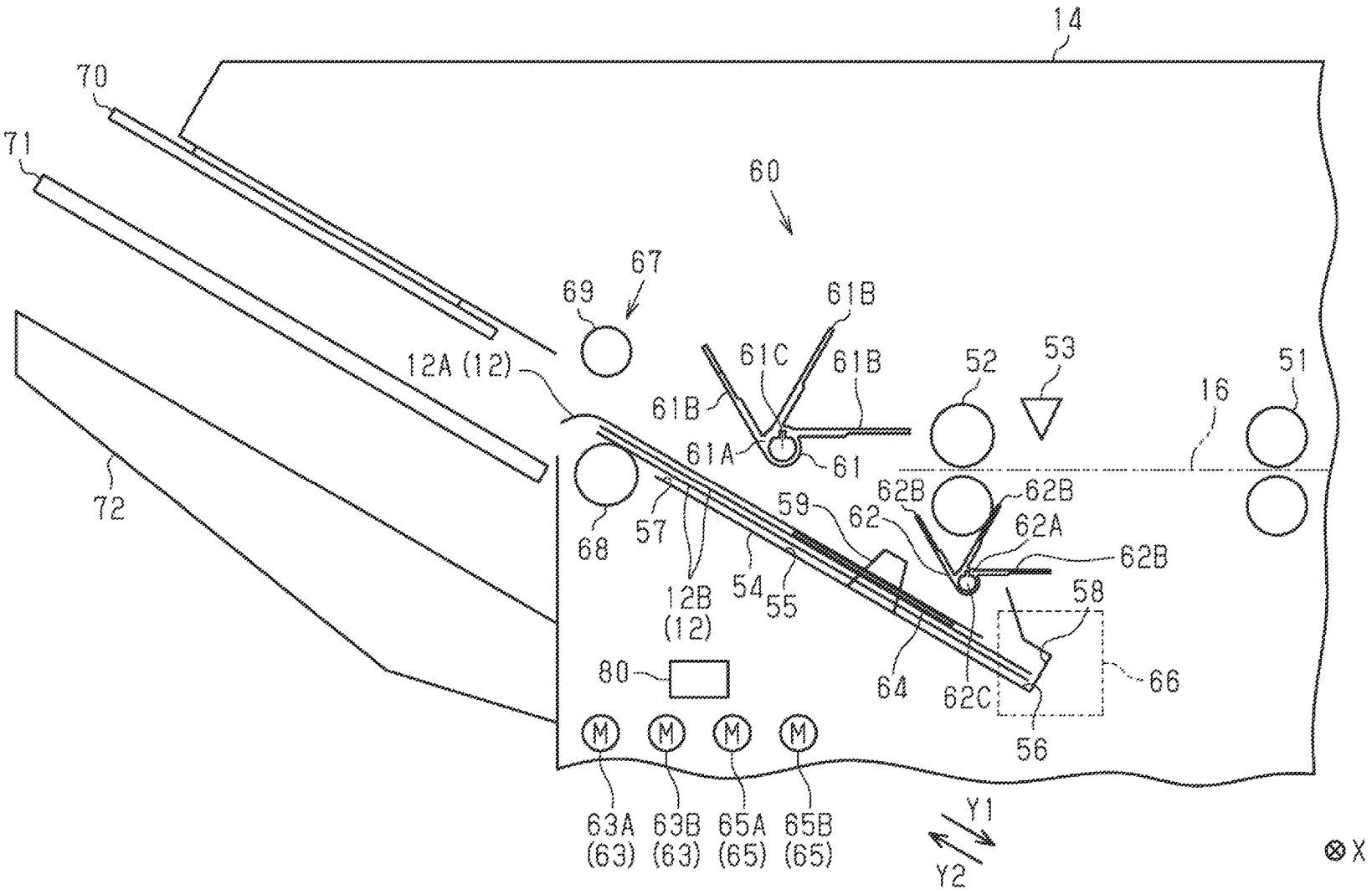
FIG. 2 is an enlarged view of FIG. 1 illustrating the post-processing device.

As illustrated in FIG. 2, the post-processing device 14 may include a processing tray 54. The processing tray 54 is a tray at which the medium 12 transported by the third transport roller pair 51 and the fourth transport roller pair 52 is placed. Specifically, the processing tray 54 is a tray for placing the medium 12, on which recording is performed by the recording unit 27 of the recording device 13, thereon. Further, the medium 12 subjected to the post-processing can be placed on the processing tray 54.

The processing tray 54 is positioned below the fourth transport roller pair 52. The processing tray 54 receives the medium 12 falling down from the fourth transport roller pair 52. With this, the medium 12 is placed on the processing tray 54. At this time, the medium 12 may be placed on the processing tray 54 so that the leading end of the medium 12 protrudes from the processing tray 54. In the present exemplary embodiment, the processing tray 54 may be a member having a friction coefficient smaller than that of the medium 12 to be placed thereon.

The processing tray 54 has a placement surface 55. The placement surface 55 is a surface at which the medium 12 is placed. The placement surface 55 includes a first placement end portion 56 and a second placement end portion 57 opposite to the first placement end portion 56. The placement surface 55 is inclined so as to extend upward from the first placement end portion 56 toward the second placement end portion 57. Specifically, the first placement end portion 56 is positioned lower than the second placement end portion 57.

The post-processing device 14 includes a first alignment unit 58. The first alignment unit 58 is continuous to the first placement end portion 56 of the processing tray 54. The first alignment unit 58 has a surface with against which the trailing end of the medium 12 placed on the processing tray 54 abuts. In the present exemplary embodiment, the placement surface 55 is inclined so as to extend upward from the first placement end portion 56 toward the second placement end portion 57. Further, the processing tray 54 has a friction coefficient smaller than that of the medium 12 to be placed thereon. Thus, the medium 12 to be placed at the placement surface 55 easily slides toward the first alignment unit 58 due to the action of the gravity, and the trailing end of the medium 12 easily abuts against the first alignment unit 58. When the trailing end of the medium 12 comes abuts against the first alignment unit 58, the trailing end of the medium 12 is aligned with the first alignment unit 58 as a reference. When a size of each of the plurality of media 12 to be placed is the same, the leading end of the medium 12 is aligned by aligning the trailing end of the medium 12. In this manner, the first alignment unit 58 is one example of the alignment unit capable of aligning the trailing end of the medium 12 placed on the processing tray 54.

The post-processing device 14 may include a pair of second alignment units 59 arrayed in the width direction X. For example, the second alignment unit 59 may be an edge guide. The pair of second alignment units 59 are provided at the processing tray 54. The pair of second alignment units 59 are configured to be movable in the width direction X. An interval between the pair of second alignment units 59 may be widened or narrowed by moving the pair of second alignment units 59. The pair of second alignment units 59 are brought into contact with both side ends of the medium 12 to be placed at the placement surface 55, and thus align both the side ends of the medium 12. The side ends of the medium 12 are two end portions excluding the leading end and the trailing end of the rectangular medium 12. In this manner, the pair of second alignment units 59 are capable of aligning both the side ends of the medium 12 placed on the processing tray 54.

The post-processing device 14 includes a transport unit 60. Although described later in detail, the transport unit 60 is configured to transport the medium 12, which is placed on the processing tray 54, toward the first alignment unit 58. The transport unit 60 may include a first paddle 61 and a second paddle 62. Hereinafter, in the present exemplary embodiment, a direction in which the transport unit 60 transports the medium 12 in the processing tray 54 is indicated with a transport direction Y1, and a direction opposite to the transport direction Y1 is denoted with an opposite direction Y2.

The post-processing device 14 includes a first transport motor 63A and a second transport motor 63B. The first transport motor 63A is a drive source for rotating the first paddle 61. The second transport motor 63B is a drive source for rotating the second paddle 62. Hereinafter, the first transport motor 63A and the second transport motor 63B are collectively referred to as transport motors 63 in some cases.

The post-processing device 14 includes a pressing unit 64. Although described later in detail, the pressing unit 64 is configured to press the medium 12, which is placed on the processing tray 54, against the placement surface 55 of the processing tray 54. In particular, when the medium 12 is newly placed as an uppermost medium in a state in which the medium 12 is already placed on the processing tray 54, the pressing unit 64 is capable of pressing the upper surface of the uppermost medium 12, which is already placed, against the processing tray 54. Further, in this case, the pressing unit 64 is positioned between the upper surface of the uppermost medium 12, which is already placed, and the bottom surface of the medium 12, which is newly placed. With this, the pressing unit 64 presses the medium 12, which is already placed on the processing tray 54, against the processing tray 54, and is also brought into contact with the bottom surface of the medium 12, which is newly placed on the processing tray 54.

One medium 12 is newly placed as an uppermost medium in a state in which one or a plurality of media 12 are already placed on the processing tray 54. After that, the transport unit 60 transports the one medium 12. Hereinafter, in such a case, the one medium 12 to be transported is referred to as a transport medium 12A in some cases. Further, in this case, the one medium 12 or each of the plurality of media 12 that are already placed on the processing tray 54 is referred to as a placed medium 12B in some cases.

The post-processing device 14 includes a first pressing motor 65A and a second pressing motor 65B. Although described later in detail, the first pressing motor 65A and the second pressing motor 65B are drive sources for moving the pressing unit 64. Hereinafter, the first pressing motor 65A and the second pressing motor 65B are collectively referred to as pressing motors 65 in some cases.

The post-processing device 14 includes a post-processing unit 66. The post-processing unit 66 is configured to execute post-processing on the medium 12 placed on the processing tray 54. In other words, the post-processing unit 66 is configured to execute the post-processing on the medium 12 received in the reception unit 50. The post-processing is, for example, a binding process for binding a plurality of media 12, but may also be a punching process, a folding process, a shift process, a bar loading process, or the like, in addition to the binding process. The punching process is a process of punching one or a plurality of media 12. The folding process is a process of folding the medium 12. The shift process is a process of shifting a position of the medium 12 and discharging the medium 12 for each part. The bar loading process is a process of discharging the medium 12 in unit of part without shifting a position thereof.

The post-processing device 14 may include a discharge unit 67. The discharge unit 67 includes, for example, a discharge driving roller 68 and a discharge driven roller 69. The discharge driving roller 68 is brought into contact with the medium 12, which is placed on the processing tray 54, from below. The discharge driven roller 69 is positioned above the discharge driving roller 68. In the present exemplary embodiment, the discharge driven roller 69 is configured to be movable. The discharge driven roller 69 approaches the discharge driving roller 68, or separates away from the discharge driving roller 68. The discharge driven roller 69 is brought into contact with the medium 12 by approaching the discharge driving roller 68. At this time, the discharge driven roller 69 is brought into contact with the medium 12, which is placed on the processing tray 54, from above.

The discharge unit 67 discharges the medium 12 by rotating the discharge driving roller 68 in a state in which the medium 12 placed on the processing tray 54 is sandwiched between the discharge driving roller 68 and the discharge driven roller 69. In this way, the discharge unit 67 discharges the medium 12 subjected to the post-processing from the processing tray 54.

The post-processing device 14 may include a guide unit 70, a pair of support members 71, and a discharge stacker 72. The guide unit 70 is provided to have a plate-like shape, for example. The guide unit 70 is brought into contact with the medium 12 discharged by the discharge unit 67, and thus suppresses an upward displacement of the medium 12.

The pair of support members 71 are positioned below the guide unit 70. The pair of support members 71 are arranged in the width direction X. The pair of support members 71 temporarily support the medium 12 discharged by the discharge unit 67. The pair of support members 71 are brought into contact with the side ends of the medium 12, and thus support the medium 12. The pair of support members 71 are configured to be movable in the width direction X. Specifically, the interval between the pair of support members 71 can be widened or narrowed. The pair of support members 71 support the side ends of the medium 12 by adjusting the interval therebetween to the width of the medium 12. The interval between the pair of support members 71 is widened in a state of supporting the medium 12. With this, the supported medium 12 falls down therefrom. Note that the pair of support members 71 may support the leading end of the medium 12 not only when the medium 12 is discharged from the processing tray 54 by the discharge unit 67 but also when the medium 12 falls down from the fourth transport roller pair 52 onto the processing tray 54.

The discharge stacker 72 is positioned below the pair of support members 71. The medium 12 falling down from the pair of support members 71 is placed at the discharge stacker 72. The discharge stacker 72 may move up and down according to an amount of placed medium 12.

The post-processing device 14 includes a post-processing control unit 80. The post-processing control unit 80 may comprehensively control driving of each mechanism in the post-processing device 14 and may control various operations performed by the post-processing device 14. The post-processing control unit 80 may include one or more processors that perform various processes according to a computer program, one or more dedicated hardware circuits, such as an application-specific integrated circuit, that performs at least some of the various processes, or a combination thereof. The processor includes a CPU and a memory. The memory is a RAM, a ROM, or the like, and stores a program code or a command configured to cause the CPU to execute the processing. The memory, that is, a computer readable medium includes all kinds of readable media accessible by a general purpose or dedicated computer.

In particular, the post-processing control unit 80 can communicate with the recording device 13 via a communication unit (not illustrated). The post-processing control unit 80 is capable of detecting the leading end and the trailing end of the carried-in medium 12, based on a signal from the sensor 53. The post-processing control unit 80 is capable of driving the transport motors 63 to rotate the first paddle 61 and the second paddle 62. The post-processing control unit 80 is capable of driving the pressing motors 65 to move the pressing unit 64. Specifically, the post-processing control unit 80 is capable of controlling an operation of the pressing unit 64. The post-processing control unit 80 is capable of causing the post-processing unit 66 to execute the post-processing. As described above, the post-processing control unit 80 being one example of the control unit is capable of controlling the post-processing device 14 and performing at least control relating to the post-processing.

Configuration of Transport Unit 60

Here, a configuration of the transport unit 60 is described in detail.

The first paddle 61 of the transport unit 60 is positioned above the processing tray 54, for example. The first paddle 61 includes a first paddle rotation body 61A, a first blade 61B, and a first paddle rotation shaft 61C. The first paddle rotation body 61A is supported by the first paddle rotation shaft 61C. The first paddle rotation body 61A rotates about the first paddle rotation shaft 61C. The first paddle rotation body 61A rotates in a counterclockwise direction in FIG. 2. The first paddle rotation shaft 61C extends in the width direction X.

The first blade 61B extends outward from first paddle rotation body 61A. One or a plurality of first blades 61B are provided. In the present exemplary embodiment, three first blades 61B are provided, but the present exemplary embodiment is not limited thereto. The first blade 61B is made of a material having elasticity, such as rubber and elastomer. The first blade 61B is provided to have a plate-like shape, for example.

According to the angle of the first paddle rotation body 61A, the distal end portion of the first blade 61B can be brought into contact with the upper surface of the upper surface of the transport medium 12A placed on the processing tray 54. In particular, when a plurality of media 12 are placed on the processing tray 54, the distal end portion of the first blade 61B can be brought into contact with the upper surface of the uppermost transport medium 12A of the plurality of media 12 placed on the processing tray 54.

When the first paddle rotation body 61A rotates in a state in which the distal end portion of the first blade 61B is brought in contact with the upper surface of the transport medium 12A placed on the processing tray 54, the first blade 61B is curved. Due to a reaction force of the curve, a frictional force is generated between the distal end portion of the first blade 61B and the upper surface of the transport medium 12A. The first paddle 61 transports the transport medium 12A in the transport direction Y1 with the frictional force between the distal end portion of the first blade 61B and the upper surface of the transport medium 12A. Specifically, the first paddle 61 rotates, and is brought into contact with the transport medium 12A in the processing tray 54. With this, the transport medium 12A is transported toward the first alignment unit 58.

Further, according to the angle of the first paddle rotation body 61A, the distal end portion of the first blade 61B is not brought into contact with the upper surface of the medium 12 placed on the processing tray 54, and is capable of separating away from the upper surface of the medium 12 placed on the processing tray 54.

When the first paddle rotation body 61A rotates, the distal end portion of the first blade 61B is changed from a contact state to a separation state with respect to the upper surface of the medium 12 placed on the processing tray 54. With this, the medium 12 is released from the reaction force of the curve of the first blade 61B. Further, in this case, the first blade 61B is changed from a curved state to a non-curved state.

The second paddle 62 of the transport unit 60 is positioned above the processing tray 54, for example. The second paddle 62 is arranged at a position closer to the first alignment unit 58 with respect to the first paddle 61. The second paddle 62 includes a second paddle rotation body 62A, a second blade 62B, and a second paddle rotation shaft 62C. The second paddle 62 has a size smaller than that of the first paddle 61, but has a configuration similar to that of the first paddle 61. Thus, for easy understanding of the present disclosure, description on the second paddle 62 is omitted. The second paddle 62 rotates, and is brought into contact with the transport medium 12A in the processing tray 54. With this, the transport medium 12A is transported toward the first alignment unit 58. Further, the first paddle 61 and the second paddle 62 are configured to be brought into contact with the medium 12 in the processing tray 54 at the same timing and to be separated away from the medium 12 in the processing tray 54 at the same timing. Further, during a period required for one rotation, the first paddle 61 and the second paddle 62 are away from each other once after the first blade 61B and the second blade 62B are brought into contact with the medium 12 once.

In this manner, the transport unit 60 rotates in contact with the upper surface of the uppermost transport medium 12A placed on the processing tray 54. Thus, the uppermost transport medium 12A placed on the processing tray 54 can be transported in the transport direction Y1. In the present exemplary embodiment, the trailing end of the medium 12 is one example of the downstream end of the medium 12 in the transport direction Y1.

Configuration of Pressing Unit 64

Figure 3:
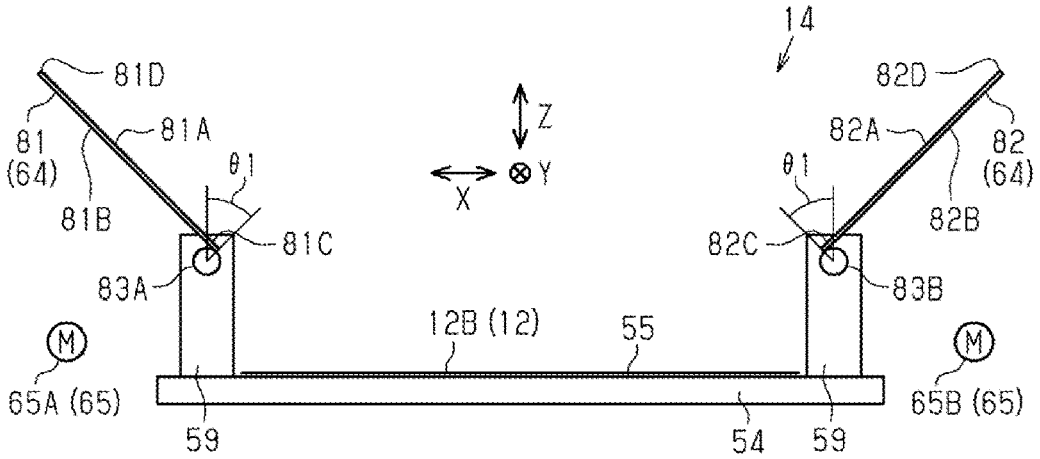
FIG. 3 is a schematic view illustrating an operation of a pressing unit.
Figure 4:
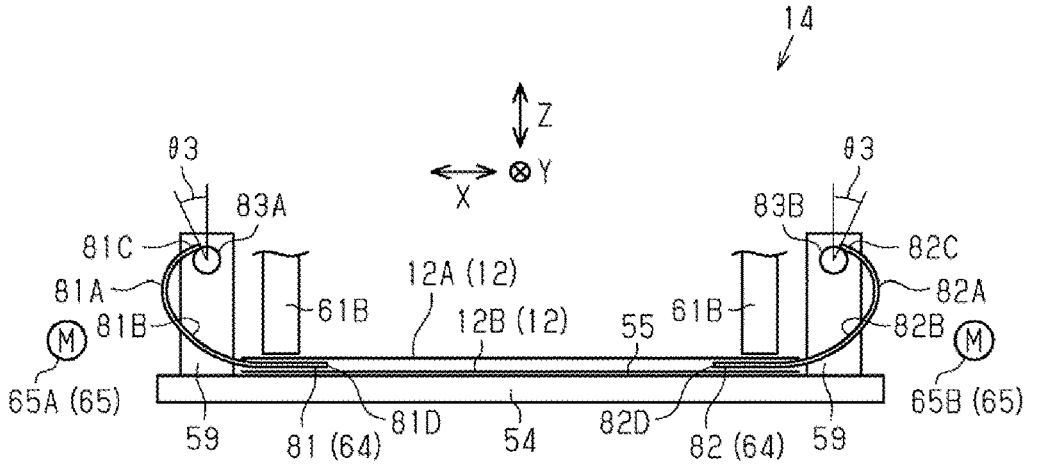
FIG. 4 is a schematic view illustrating an operation of the pressing unit.
Figure 5:
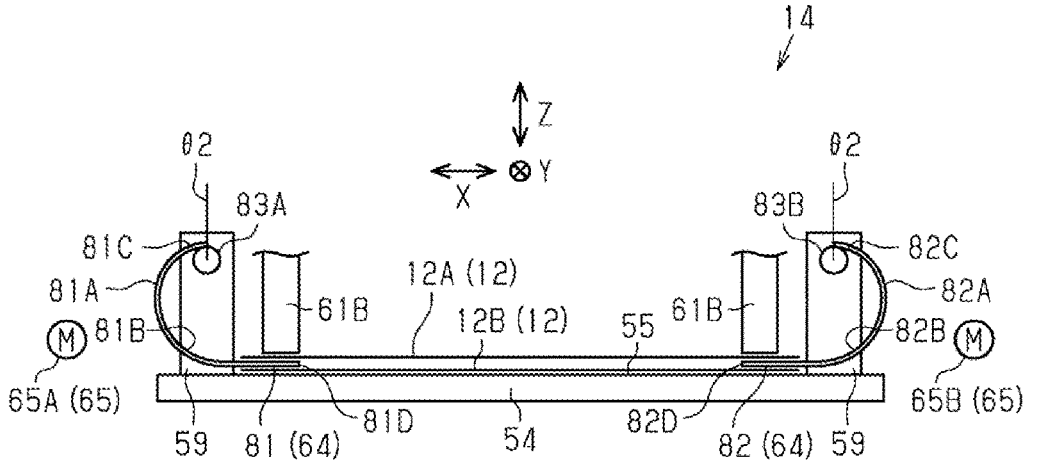
FIG. 5 is a schematic view illustrating an operation of the pressing unit.

Next, with reference to FIG. 3 to FIG. 5, a configuration of the pressing unit 64 is described. Each of FIG. 3 to FIG. 5 is a view illustrating the processing tray 54 seen in the opposite direction Y2. In the present exemplary embodiment, a direction that is vertical to the placement surface 55 of the processing tray 54 and orthogonal to the transport direction Y1 and the opposite direction Y2 is indicated with a vertical direction Z. Further, for easy understanding of the present disclosure, the first alignment unit 58 and the second paddle 62 are omitted in illustration.

As illustrated in FIG. 3 to FIG. 5, the pressing unit 64 may include a first pressing unit 81 and the second pressing unit 82. The first pressing unit 81 and the second pressing unit 82 are a pair of members configured to respectively press both the side ends of the placed medium 12B against the processing tray 54.

The first pressing unit 81 may have a sheet-like shape having a first surface 81A and a second surface 81B. The first pressing unit 81 may be made of a material having elasticity, such as a flexible resin sheet. The first pressing unit 81 has a friction coefficient smaller than that of the medium 12 placed on the processing tray 54. The first surface 81A has a friction coefficient greater than that of the second surface 81B. The first pressing unit 81 includes a first base end portion 81C and the first distal end portion 81D opposite to the first base end portion 81C.

The post-processing device 14 may include a first rotation shaft 83A. The first rotation shaft 83A is fixed to the first base end portion 81C. The first rotation shaft 83A is rotatably pivoted to one of the pair of second alignment units 59. In this manner, the first pressing unit 81 is configured to be rotatable about the first rotation shaft 83A fixed to the first base end portion 81C. In particular, the first pressing unit 81 is configured to be rotatable in a clockwise direction in FIG. 3 to FIG. 5. The first pressing unit 81 is movable in the width direction X along with movement of the second alignment unit 59 in the width direction X, to which the first rotation shaft 83A is pivoted.

The second pressing unit 82 may have a sheet-like shape having a first surface 82A and a second surface 82B. The second pressing unit 82 may be made of a material having elasticity, such as a flexible resin sheet. The second pressing unit 82 has a friction coefficient smaller than that of the medium 12 placed on the processing tray 54. The first surface 82A has a friction coefficient greater than that of the second surface 82B. The second pressing unit 82 includes a second base end portion 82C and a second distal end portion 82D opposite to the second base end portion 82C.

The post-processing device 14 may include the second rotation shaft 83B. The second rotation shaft 83B is fixed to the second base end portion 82C. The second rotation shaft 83B is rotatably pivoted to the other one of the pair of second alignment units 59. In this manner, the second pressing unit 82 is configured to be rotatable about the second rotation shaft 83B fixed to the second base end portion 82C. In particular, the second pressing unit 82 is configured to be rotatable in a counterclockwise direction in FIG. 3 to FIG. 5. The second pressing unit 82 is movable in the width direction X along with movement of the second alignment unit 59 in the width direction X, to which the second rotation shaft 83B is pivoted.

As illustrated in FIG. 3, the pressing unit 64 is movable to a retraction position with driving of the pressing motors 65. The retraction position is a position at which a phase of the first rotation shaft 83A and the second rotation shaft 83B is a first phase 01 with the vertical direction Z as a reference. The retraction position is a position at which the medium 12 placed on the processing tray 54 and the pressing unit 64 do not abut against each other. As described above, the retraction position is a position for canceling the pressing applied to the medium 12 placed on the processing tray 54.

As illustrated in FIG. 4, the pressing unit 64 is movable to a second pressing position. The second pressing position is a position at which a phase of the first rotation shaft 83A and the second rotation shaft 83B is a third phase 03 with the vertical direction Z as a reference. The first pressing unit 81 rotates in a clockwise direction in FIG. 3 to FIG. 5, and thus moves from the retraction position to the second pressing position. The second pressing unit 82 rotates in a counterclockwise direction in FIG. 3 to FIG. 5, and thus moves from the retraction position to the second pressing position.

In this case, while moving from the retraction position to the second pressing position, the pressing unit 64 is curved so that the first surfaces 81A and 82A abut against the upper surface of the placed medium 12B after the first distal end portion 81D and the second distal end portion 82D abut against the placed medium 12B placed on the processing tray 54. The second pressing position is a position of pressing the medium 12 placed on the processing tray 54, as described above.

As illustrated in FIG. 5, the pressing unit 64 is movable to a first pressing position. The first pressing position is a position of pressing the medium 12 placed on the processing tray 54. A first position is a position at which a phase of the first rotation shaft 83A and the second rotation shaft 83B is a second phase 02 with the vertical direction Z as a reference. The first pressing unit 81 rotates in a clockwise direction in FIG. 3 to FIG. 5, and thus moves from the retraction position to the first pressing position. The second pressing unit 82 rotates in a counterclockwise direction in FIG. 3 to FIG. 5, and thus moves from the retraction position to the first pressing position.

In this case, while moving from the retraction position to the second pressing position, the pressing unit 64 is curved so that the first surfaces 81A and 82A abut against the upper surface of the placed medium 12B after the first distal end portion 81D and the second distal end portion 82D abut against the placed medium 12B placed on the processing tray 54. The first pressing position is a position of pressing the medium 12 placed on the processing tray 54, as described above.

As illustrated in FIG. 4 and FIG. 5, the first pressing position is a position at which the pressing unit 64 has a large curvature and the pressing unit 64 is curved more significantly than at the second pressing position. Thus, the pressing unit 64 has a pressing force of pressing the medium 12 placed on the processing tray 54, which is larger when the pressing unit 64 is at the first pressing position than at the second pressing position. Specifically, the first pressing position is a position at which a pressing force of pressing the medium 12 placed on the processing tray 54 is larger than at the second pressing position. Hereinafter, the first pressing position and the second pressing position are collectively referred to as a pressing position in some cases.

Description is made on a specific example in which the transport unit 60 transports the transport medium 12A after the transport medium 12A is newly placed as an uppermost medium in a state in which the placed medium 12B is already placed on the processing tray 54.

The pressing unit 64 at the pressing position is positioned between the uppermost placed medium 12B, which is placed on the processing tray 54, and the transport medium 12A. In particular, when the pressing unit 64 is at the pressing position, the first surfaces 81A and 82A are brought into contact with the uppermost placed medium 12B, which is placed on the processing tray 54, and the second surfaces 81B and 82B are brought into contact with the bottom surface of the transport medium 12A.

Further, when the pressing unit 64 is at the pressing position, the distal end portion of the first blade 61B may be positioned below a first contact position with the transport medium 12A, depending on a position of the second alignment unit 59. With this, transport performance with which the transport unit 60 transports the transport medium 12A can be improved. When the pressing unit 64 is at the pressing position, the pressing unit 64 may be positioned below the first contact position or may not be positioned below the first contact position, depending on a position of the second alignment unit 59.

In the present exemplary embodiment, when the pressing unit 64 is at the pressing position, the distal end of portion of the second blade 62B is not positioned below a second contact position with the transport medium 12A. However, the present exemplary embodiment is not limited thereto. The pressing unit 64 at the pressing position may be positioned below the second contact position. When the pressing unit 64 is at the pressing position, the pressing unit 64 may be positioned below the second contact position or may not be positioned below the second contact position, depending on a position of the second alignment unit 59.

Alignment Control Processing

Figure 6:
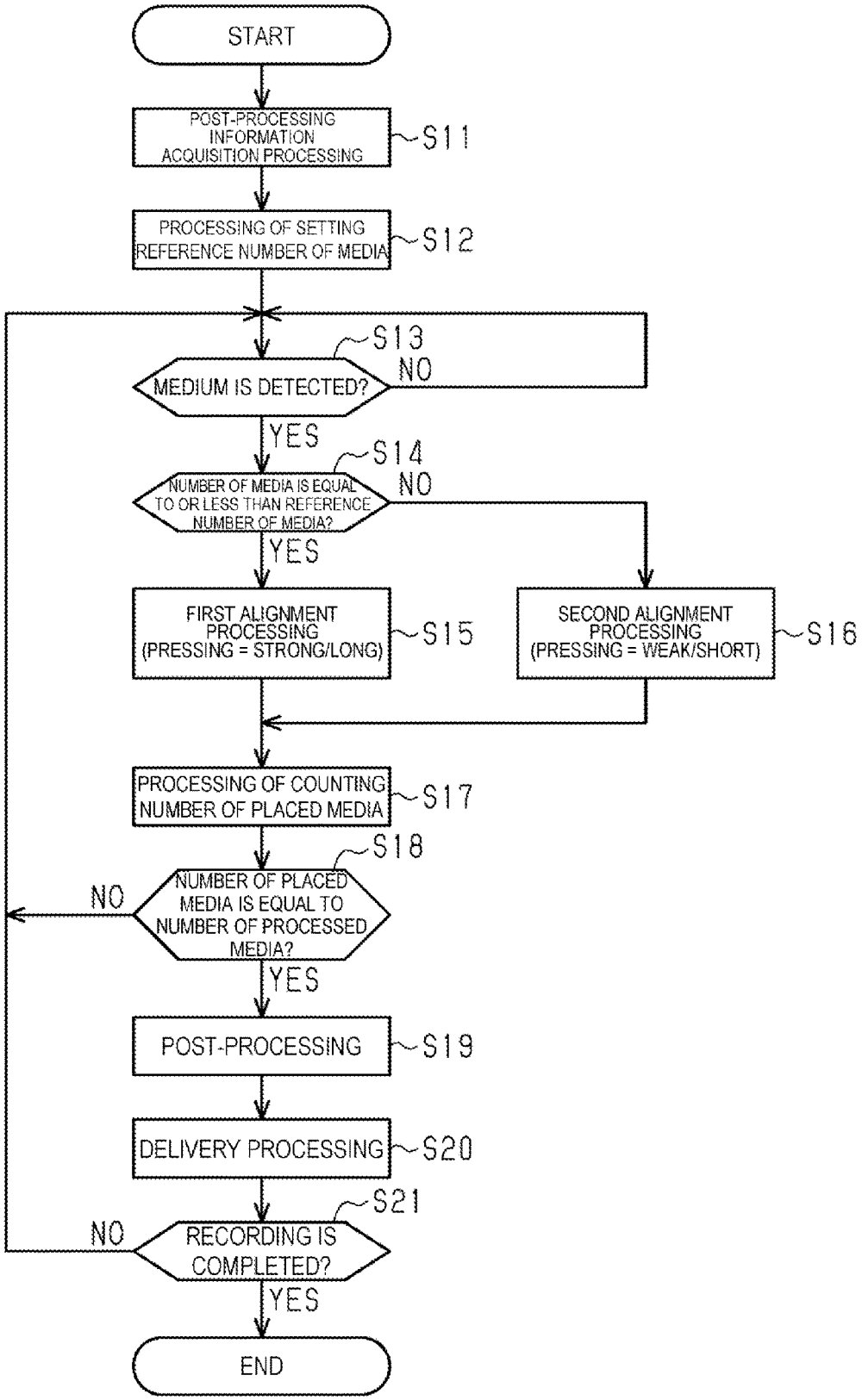
FIG. 6 is a flowchart illustrating alignment control processing.

Next, with reference to FIG. 6, alignment control processing is described. The alignment control processing is a process performed by the post-processing control unit 80 of the post-processing device 14 when the recording command involving the post-processing is input.

As illustrated in FIG. 6, in Step S11, the post-processing control unit 80 acquires post-processing information. The post-processing information contains medium type information, by communication with the recording device 13. The post-processing information contains information relating to the number of media to be processed, by communication with the recording device 13. When Step S11 is terminated, the post-processing control unit 80 proceeds to Step S12.

In Step S12, the post-processing control unit 80 executes processing of setting the reference number of media. In this processing, the post-processing control unit 80 specifies a type of the medium 12 after recording, based on the post-processing information acquired in Step S11. The post-processing control unit 80 executes setting relating to a reference number of media, based on the specified type of the medium 12 after recording. The reference number of media is the number of placed media 12B used as a selection reference for executing any one of first alignment processing and second alignment processing, which are described later in detail.

Figures 7, 8:
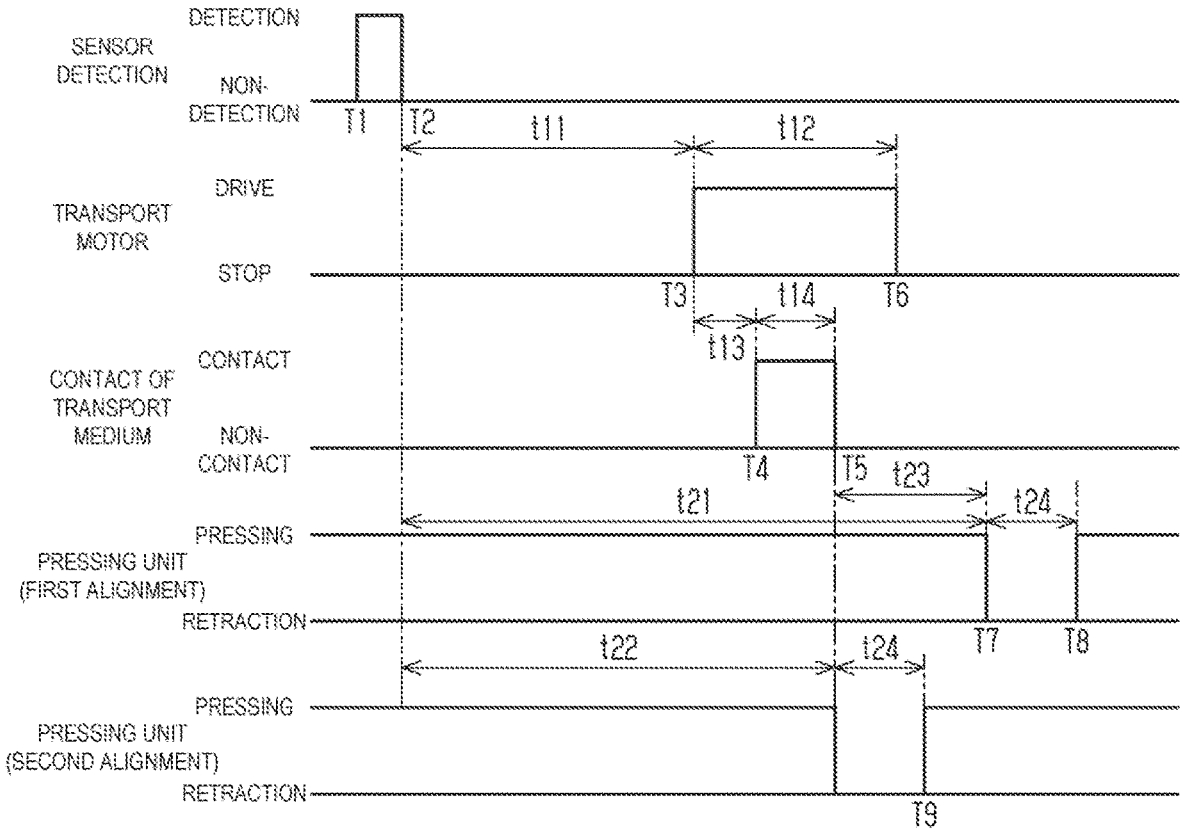
FIG. 7 is a schematic view illustrating a relationship between medium types and a reference number of media.
FIG. 8 is a timing chart illustrating an operation of a transport unit and an operation of the pressing unit.

In particular, the post-processing control unit 80 sets information relating to the reference number of media, with reference to a media reference number table TA illustrated in FIG. 7. The media reference number table TA is a table in which a type of the medium 12 and information relating to the reference number of media are associated with each other, and is a table with which the information relating to the reference number of media can be changed according to a type of the medium 12. With this, the post-processing control unit 80 is capable of changing the reference number of media to a number according to a type of the medium 12. When Step S12 is terminated, the post-processing control unit 80 proceeds to Step S13.

Here, with reference to FIG. 7, the media reference number table TA is described.

As illustrated in FIG. 7, the media reference number table TA is stored in the memory of the post-processing control unit 80. The media reference number table TA is a table in which a type of the medium 12, a control type, and information relating to the reference number of media are associated with each other.

Types of the medium 12 include different materials of the medium 12, such as a normal sheet paper and cardboard. Types of the medium 12 include different sizes of the medium 12 such as an A3 size, an A4 size, and a B4 size. Similarly, types of the medium 12 may include different weights of the medium 12.

Types of the medium 12 include different orientations of the medium 12, such as A4 vertical printing, and A4 lateral printing. The medium 12 is curled at different degrees according to directions in which fibers are arrayed. Similarly, types of the medium 12 may include different fiber directions of the medium 12.

As a specific example, when a medium type MA is a type of the medium 12, the first alignment processing and the second alignment processing as control types and a first number S1 as the reference number of media are associated with each other. When a medium type MB is a type of the medium 12, the first alignment processing and the second alignment processing as control types and a second number S2 as the reference number of media are associated with each other. The first number S1 is more than the second number S2. For example, the first number S1 may be eight, and the second number S2 may be six.

When a medium type MC is a type of the medium 12, the first alignment processing as a control type and first control information as the reference number of media are associated with each other. The first control information is information with which not the second alignment processing but the first alignment processing can be determined as processing to be executed. In other words, the first control information is information for determining that the number of media is equal to or less than the reference number of media, not the other way around, in Step S14.

When a medium type MD is a type of the medium 12, the second alignment processing as a control type and second control information as the reference number of media are associated with each other. The second control information is information with which not the first alignment processing but the second alignment processing is determined as processing to be executed. In other words, the second control information is information for determining that the number of media is not equal to or less than the reference number of media, not the other way around, in Step S14.

Referring back to the description of the alignment control processing in FIG. 6, in Step S13, the post-processing control unit 80 determines whether the trailing end of the medium 12 is detected based on a signal from the sensor 53. When it is determined that the trailing end of the medium 12 is not detected, the post-processing control unit 80 executes Step S13 again. In this manner, the post-processing control unit 80 stands by until it is determined that the trailing end of the medium 12 is detected. When it is determined that the trailing end of the medium 12 is detected, the post-processing control unit 80 proceeds to Step S14.

In Step S14, the post-processing control unit 80 determines whether the number of placed media 12B placed on the processing tray 54 is equal to or less than the reference number of media. In this processing, the post-processing control unit 80 reads out the information relating to the reference number of media, which is set in Step S12. The post-processing control unit 80 reads out a value from a placed-medium counter, and specifies the number of placed media 12B. The placed-medium counter is allocated to the memory of the post-processing control unit 80. The post-processing control unit 80 determines whether the number of placed media 12B is equal to or less than the reference number of media, based on the information relating to the reference number of media and the number of placed media 12B.

In particular, when the first control information is stored as the information relating to the reference number of media, the post-processing control unit 80 determines that the number of placed media 12B is equal to or less than the reference number of media. When the second control information is stored as the information relating to the reference number of media, the post-processing control unit 80 determines that the number of placed media 12B is not equal to or less than the reference number of media.

When it is determined that the number of placed media 12B is equal to or less than the reference number of media, the post-processing control unit 80 proceeds to Step S15. When it is determined that the number of placed media 12B is not equal to or less than the reference number of media, the post-processing control unit 80 proceeds to Step S16.

In Step S15, the post-processing control unit 80 executes the first alignment processing being an example of the first control. Although described later in detail, in the first alignment processing, after the post-processing control unit 80 causes the transport unit 60 to transport the transport medium 12A in the transport direction Y1, and the transport unit 60 is separated away from the transport medium 12A, the post-processing control unit 80 causes the pressing unit 64 to move to the retraction position. When Step S15 is terminated, the post-processing control unit 80 proceeds to Step S17.

In Step S16, the post-processing control unit 80 executes the second alignment processing being an example of the second control. Although described later in detail, in the second alignment processing, when the post-processing control unit 80 causes the transport unit 60 to transport the transport medium 12A in the transport direction Y1, and the transport unit 60 is separated away from the transport medium 12A, the post-processing control unit 80 causes the pressing unit 64 to move to the retraction position. When Step S16 is terminated, the post-processing control unit 80 proceeds to Step S17.

In this manner, the post-processing control unit 80 is capable of performing switching between the first alignment processing and the second alignment processing. In other words, the post-processing control unit 80 is capable of executing the first alignment processing and the second alignment processing.

In particular, in a case in which a type of the medium 12 is the medium type MA or the medium type MB, when the number of placed medium 12B placed on the processing tray 54 is equal to or less than the reference number of media, the post-processing control unit 80 executes the first alignment processing. In a case in which a type of the medium 12 is the medium type MA or the medium type MB, when the number of placed medium 12B placed on the processing tray 54 is more than the reference number of media, the post-processing control unit 80 executes the second alignment processing.

Further, when a type of the medium 12 is the medium type MC, the post-processing control unit 80 executes the first alignment processing. When a type of the medium 12 is the medium type MD, the post-processing control unit 80 executes the second alignment processing. Specifically, the post-processing control unit 80 executes at least any one of the first alignment processing and the second alignment processing, according to a type of the medium 12.

In Step S17, the post-processing control unit 80 executes processing of counting the number of placed media. In this processing, the post-processing control unit 80 updates the placed-medium counter, and thus counts the number of placed media 12B placed on the processing tray 54. In this processing, the number of placed media 12B placed on the processing tray 54 includes the transport medium 12A transported in Step S15 or Step S16. When Step S17 is terminated, the post-processing control unit 80 proceeds to Step S18.

In Step S18, the post-processing control unit 80 determines whether the number of media 12 placed on the processing tray 54 reaches the number of media to be processed. The post-processing control unit 80 is capable of specifying the number of media 12 placed on the processing tray 54, based on a detection result obtained by the sensor 53. When it is determined that the number of placed media does not reach the number of media to be processed, the post-processing control unit 80 proceeds to Step S13. When it is determined that the number of placed media reaches the number of media to be processed, the post-processing control unit 80 proceeds to Step S19.

In Step S19, the post-processing control unit 80 causes the post-processing unit 66 to execute the post-processing on the medium 12 placed on the processing tray 54. Further, after causing the post-processing unit 66 to execute the post-processing, the post-processing control unit 80 drives the pressing motors 65 to move the pressing unit 64 to the retraction position. When Step S19 is terminated, the post-processing control unit 80 proceeds to Step S20.

In Step S20, the post-processing control unit 80 executes delivery processing. In this processing, the post-processing control unit 80 delivers the plurality of media 12, which are subjected to the post-processing, from the processing tray 54 to the support members 71, and places the plurality of media 12, which are subjected to the post-processing, on the discharge stacker 72. The post-processing control unit 80 initializes the placed-medium counter. When Step S20 is terminated, the post-processing control unit 80 proceeds to Step S21.

In Step S21, the post-processing control unit 80 determines whether the recording is completed. When all the media 12 after recording are sent out to the support members 71, the post-processing control unit 80 determines that recording is completed. When it is determined that the recording is not completed, the post-processing control unit 80 proceeds to Step S13. When it is determined that the recording is completed, the post-processing control unit 80 terminates the alignment control processing.

First Alignment Processing and Second Alignment Processing

Here, with reference to FIG. 8, the first alignment processing and the second alignment processing are described in detail. In FIG. 8, detection of the medium 12, which is performed by the sensor 53, driving of the transport motors 63, contact between the transport unit 60 and the medium 12, and positioning of the pressing unit 64 at the pressing position are respectively shown in the vertical axis, and the time is shown in the horizontal axis.

In the first alignment processing in Step S15, the post-processing control unit 80 executes transport processing and first pressing processing. The transport processing is processing of transporting the transport medium 12A. The first pressing processing is processing of pressing the placed medium 12B against the processing tray 54.

In the transport processing, when a time period t11 elapses from detection of the trailing end of the medium 12, the post-processing control unit 80 starts rotation of the first paddle 61 and the second paddle 62 with driving of the transport motors 63. The time period t11 is a sufficient time period from detection of the trailing end of the medium 12 until the medium 12 falls downs from the fourth transport roller pair 52 onto the processing tray 54, the medium 12 is placed on the processing tray 54, and then the medium 12 slides toward the first alignment unit 58 and stops. Further, when a time period t12 elapses from start of rotation of the first paddle 61, the post-processing control unit 80 terminates rotation of the first paddle 61 and the second paddle 62 along with termination of driving of the transport motors 63.

In the first pressing processing, in a case in which a time period t21 elapses from detection of the trailing end of the medium 12, when the pressing unit 64 is not at the retraction position, the post-processing control unit 80 causes the pressing unit 64 to move to the retraction position with driving of the pressing motors 65. The time period t21 is a time period longer than a time period required for the first blade 61B and the second blade 62B to be separated away from the upper surface of the transport medium 12A from detection of the trailing end of the medium 12.

In a case in which the time period t21 elapses from detection of the trailing end of the medium 12, when the pressing unit 64 is at the retraction position, the post-processing control unit 80 is not required to cause the pressing unit 64 to move from the retraction position. In the present exemplary embodiment, only when the placed medium 12B is not placed on the processing tray 54, the pressing unit 64 is at the retraction position even before the time period t21 elapses from detection of the trailing end of the medium 12. Thus, only in a case in which the placed medium 12B is not placed on the processing tray 54, when the time period t21 elapses from detection of the trailing end of the medium 12, the pressing unit 64 is continuously at the retraction position.

When a time period t24 elapses from the time when the pressing unit 64 moves to the retraction position, the post-processing control unit 80 causes the pressing unit 64 to move from the retraction position to the first pressing position with driving of the pressing motors 65.

Meanwhile, in the second alignment processing in Step S16, the post-processing control unit 80 executes the transport processing and second pressing processing. The transport processing in the second alignment processing is processing similar to the transport processing in the first alignment processing, and hence description therefor is omitted. The second pressing processing is processing of pressing the placed medium 12B against the processing tray 54, but is processing different from the first pressing processing.

In the second pressing processing, in a case in which a time period t22 elapses from detection of the trailing end of the medium 12, when the pressing unit 64 is not at the retraction position, the post-processing control unit 80 causes the pressing unit 64 to move to the retraction position with driving of the pressing motors 65. The time period t22 is a time period equal to a time period required for the first blade 61B and the second blade 62B to be separated away from the upper surface of the transport medium 12A from detection of the trailing end of the medium 12, and is a time period shorter than the time period t21.

In a case in which the time period t22 elapses from detection of the trailing end of the medium 12, when the pressing unit 64 is at the retraction position, the post-processing control unit 80 is not required to cause the pressing unit 64 to move from the retraction position.

When the time period t24 elapses from the time when the pressing unit 64 moves to the retraction position, the post-processing control unit 80 causes the pressing unit 64 to move from the retraction position to the second pressing position with driving of the pressing motors 65.

Here, description is made on a specific example in which the transport medium 12A is newly placed as an uppermost medium in a state in which one or a plurality of placed media 12B are placed on the processing tray 54. In such a case, in the first alignment processing and the second alignment processing, the post-processing control unit 80 similarly causes the transport unit 60 to transport the transport medium 12A after the transport medium 12A is placed.

Further, in each of the first alignment processing and the second alignment processing, the post-processing control unit 80 causes the pressing unit 64 to move from the pressing position to the retraction position. With this, the post-processing control unit 80 causes the pressing unit 64 to press at least one placed medium 12B, which is placed on the processing tray 54, against the processing tray 54.

In particular, in the first alignment processing, the time period t21 required for the pressing unit 64 to move to the retraction position from detection of the trailing end of the medium 12 is longer than a time period required for the first blade 61B and the second blade 62B to be separated away from the upper surface of the transport medium 12A. Specifically, the first alignment processing is processing of moving the pressing unit 64 from the first pressing position to the retraction position after the post-processing control unit 80 causes the transport unit 60 to transport the transport medium 12A, and the transport unit 60 is separated from the transport medium 12A.

Meanwhile, in the second alignment processing, the time period t22 required for the pressing unit 64 to move to the retraction position from detection of the trailing end of the medium 12 is equal to a time period required for the first blade 61B and the second blade 62B to be separated away from the upper surface of the transport medium 12A. Specifically, the second alignment processing is processing of moving the pressing unit 64 from the second pressing position to the retraction position when the post-processing control unit 80 causes the transport unit 60 to transport the transport medium 12A, and the transport unit 60 is separated from the transport medium 12A.

Further, the post-processing control unit 80 is capable of changing a pressing force of the pressing unit 64 by causing the pressing unit 64 to move to the first pressing position or to the second pressing position. In particular, the post-processing control unit 80 causes a pressing force of the pressing unit 64 in the first alignment processing to be stronger than that in the second alignment processing.

Operations of First Exemplary Embodiment

Operations of the first exemplary embodiment are described.

As illustrated in FIG. 8, at timing indicated with a reference symbol T1, the leading end of the medium 12 being transported is detected based on a signal from the sensor 53. After that, at timing indicated with a reference symbol T2, the trailing end of the medium 12 being transported is detected based on a signal from the sensor 53.

When the time period t11 elapses from the timing indicated with the reference symbol T2, rotation of the first paddle 61 and the second paddle 62 is started with driving of the transport motors 63 at timing indicated with a reference symbol T3. Further, when the time period t12 elapses from the timing indicated with the reference symbol T3, driving of the transport motors 63 is terminated, and thus rotation of the first paddle 61 and the second paddle 62 is terminated at timing indicated with a reference symbol T6.

In this case, when a time period t13 elapses from the timing indicated with the reference symbol T3, the first blade 61B and the second blade 62B are brought into contact with the upper surface of the transport medium 12A at timing indicated with a reference symbol T4. With this, in a state in which the first blade 61B and the second blade 62B are brought into contact with the upper surface of the transport medium 12A, the first paddle 61 and the second paddle 62 rotate. Further, when a time period t14 elapses from the timing indicated with the reference symbol T4, the first blade 61B and the second blade 62B are separated away from the upper surface of the transport medium 12A at timing indicated with a reference symbol T5.

Meanwhile, when one or a plurality of placed media 12B are placed on the processing tray 54 before the timing indicated with the reference symbol T1, the pressing unit 64 is at the pressing position at the timing indicated with the reference symbol T1.

In a case in which the first alignment processing is executed, when the time period t21 elapses from the timing indicated with the reference symbol T2, the pressing unit 64 moves from the first pressing position to the retraction position with driving of the pressing motors 65 at timing indicated with a reference symbol T7.

The timing indicated with the reference symbol T7 is timing at which a time period t23 elapses from the timing indicated with the reference symbol T5. Specifically, in the first alignment processing, the pressing unit 64 moves from the first pressing position to the retraction position after the first blade 61B and the second blade 62B are separated away from the upper surface of the transport medium 12A.

In this manner, in the first alignment processing, when the first blade 61B and the second blade 62B are separated away from the upper surface of the transport medium 12A, the placed medium 12B can be pressed against the processing tray 54 until warpage of the transport medium 12A is assumed to be released.

After that, when the time period t24 elapses from the timing indicated with the reference symbol T7, the pressing unit 64 moves from the retraction position to the first pressing position with driving of the pressing motors 65 at timing indicated with a reference symbol T8.

Meanwhile, in a case in which the second alignment processing is executed, when the time period t22 elapses from the timing indicated with the reference symbol T2, the pressing unit 64 moves from the second pressing position to the retraction position with driving of the pressing motors 65 at the timing indicated with the reference symbol T5.

The time period t22 is equal to a time period being a sum of the time period t11, the time period t13, and the time period t14. Specifically, in the second alignment processing, when the first blade 61B and the second blade 62B are separated away from the upper surface of the transport medium 12A, the pressing unit 64 moves from the second pressing position to the retraction position.

After that, when the time period t24 elapses from the timing indicated with the reference symbol T5, the pressing unit 64 moves from the retraction position to the second pressing position with driving of the pressing motors 65 at timing indicated with a reference symbol T9.

In this manner, in the second alignment processing, the placed medium 12B can be pressed against the processing tray 54 until the first blade 61B and the second blade 62B are separated away from the upper surface of the transport medium 12A.

Further, in the second alignment processing, a time period during which the pressing unit 64 moves from the retraction position to the second pressing position again can be shortened as compared to the first alignment processing. In this manner, when the second alignment processing is executed, an alignment interval can be shortened as compared to the first alignment processing. With this, with the post-processing device 14, the post-processing can be executed in a short time period. Further, a transport speed at which the medium 12 is transported from the recording device 13 can be increased.

In the present exemplary embodiment, when the placed medium 12B is not placed on the processing tray 54 at the timing indicated with the reference symbol T1, the pressing unit 64 is at the retraction position. When the first alignment processing is executed, the pressing unit 64 is at the retraction position until the timing indicated with the reference symbol T8, and moves from the retraction position to the first pressing position at the timing indicated with the reference symbol T8. Meanwhile, when the second alignment processing is executed, the pressing unit 64 is at the retraction position until the timing indicated with the reference symbol T9, and moves from the retraction position to the second pressing position at the timing indicated with the reference symbol T9.

In this manner, the transport medium 12A is transported, and the placed medium 12B is pressed. Thus, alignment deviation of the medium 12 placed on the processing tray 54 can be suppressed. Further, description is made on a specific example in which the transport medium 12A is newly placed as an uppermost medium in a state in which one placed medium 12B is already placed on the processing tray 54. In the present exemplary embodiment, for easy understanding of the present disclosure, illustration is given in a state in which an interval between the media 12 and an interval between the medium 12 and the pressing unit 64 are sufficiently large.

Figure 9:
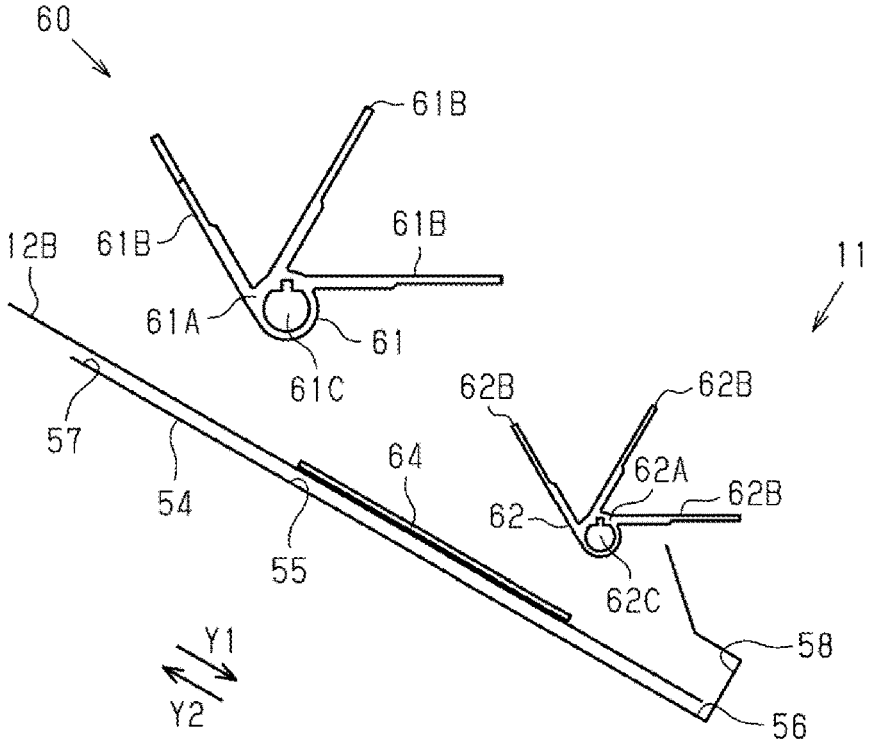
FIG. 9 is a schematic view illustrating the medium placed on a processing tray.

As illustrated in FIG. 9, the one placed medium 12B is placed on the processing tray 54. In this case, the pressing unit 64 presses the upper surface of the one placed medium 12B against the processing tray 54.

Figure 10:
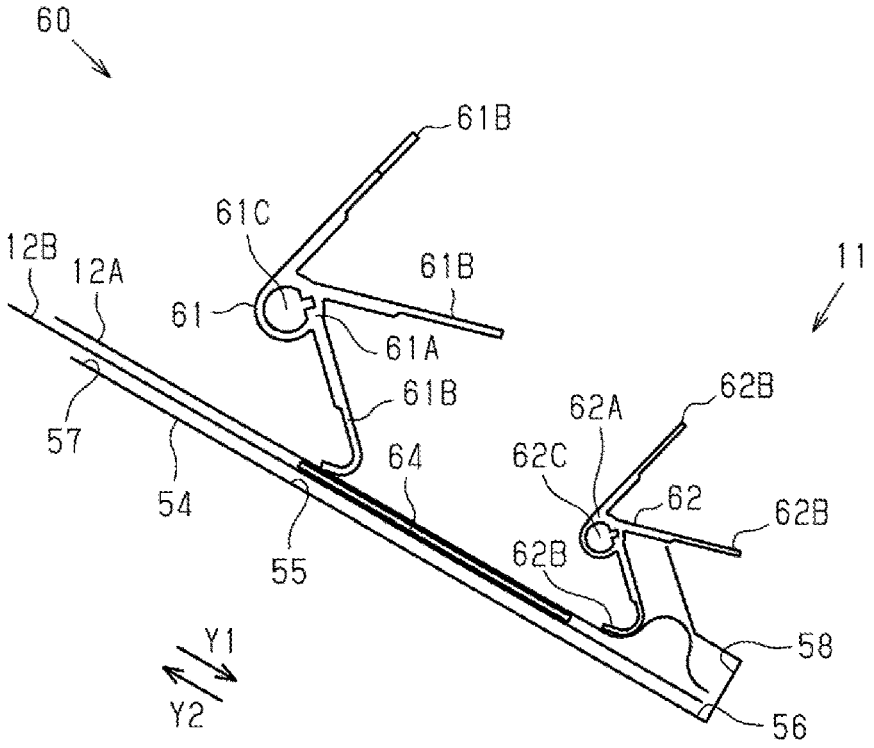
FIG. 10 is a schematic view illustrating the medium placed on the processing tray.

Further, as illustrated in FIG. 10, the transport medium 12A is newly placed as an uppermost medium in the processing tray 54. Further, as a result of transporting the transport medium 12A in the transport direction Y1 by the transport unit 60, the trailing end of the transport medium 12A abuts against the first alignment unit 58. In a certain situation, the transport medium 12A is warped due to a transport force of the transport unit 60 in some cases.

Figure 11:
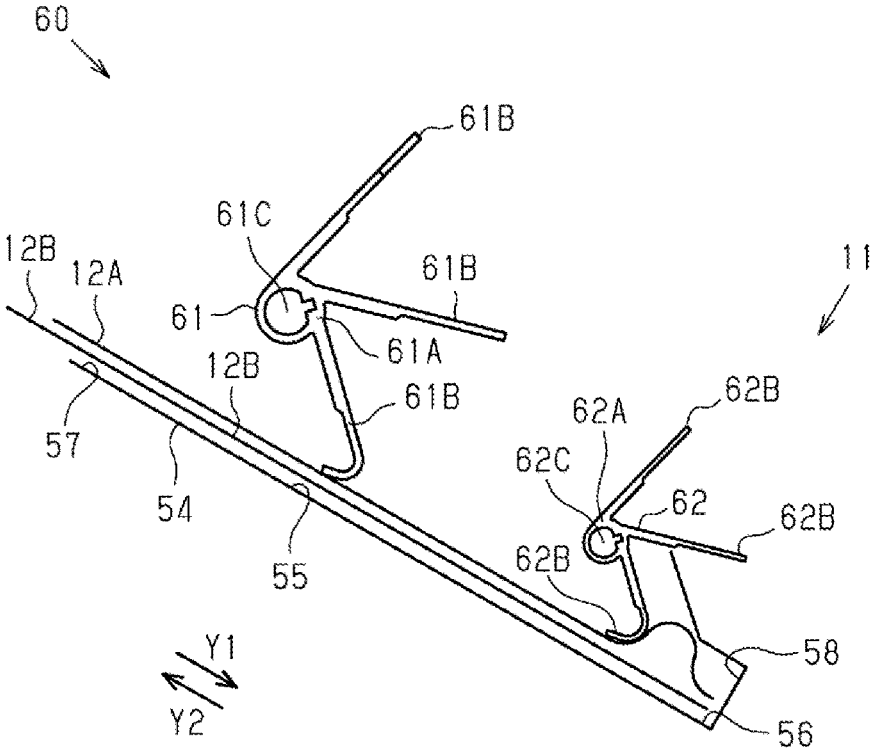
FIG. 11 is a schematic view illustrating the medium placed on the processing tray.

As illustrated in FIG. 11, regardless of the number of placed media 12B, in a case in which the second alignment processing is executed, when the first blade 61B and the second blade 62B are separated away from the upper surface of the transport medium 12A, the pressing unit 64 moves from the second pressing position to the retraction position, which is different from the present exemplary embodiment.

Figure 12:
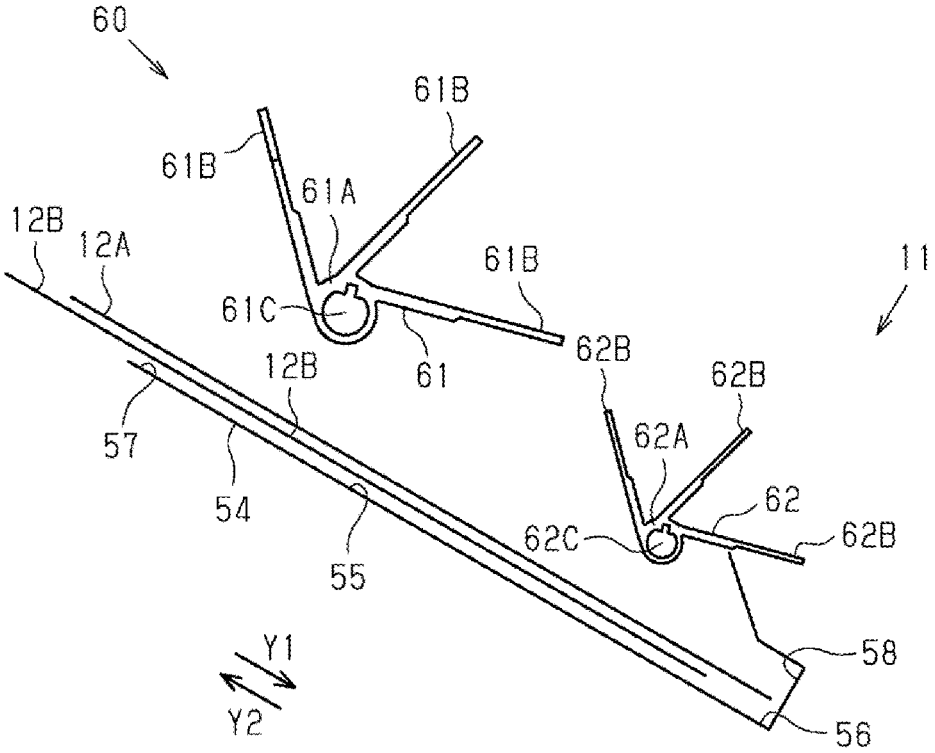
FIG. 12 is a schematic view illustrating the medium placed on the processing tray.

Further, as illustrated in FIG. 12, when the first blade 61B and the second blade 62B are separated away from the upper surface of the transport medium 12A, warpage of the transport medium 12A is released. In this case, a restoring force for canceling warpage of the transport medium 12A is applied to the placed medium 12B. In a certain situation, the placed medium 12B moves in the opposite direction Y2.

Figure 13:
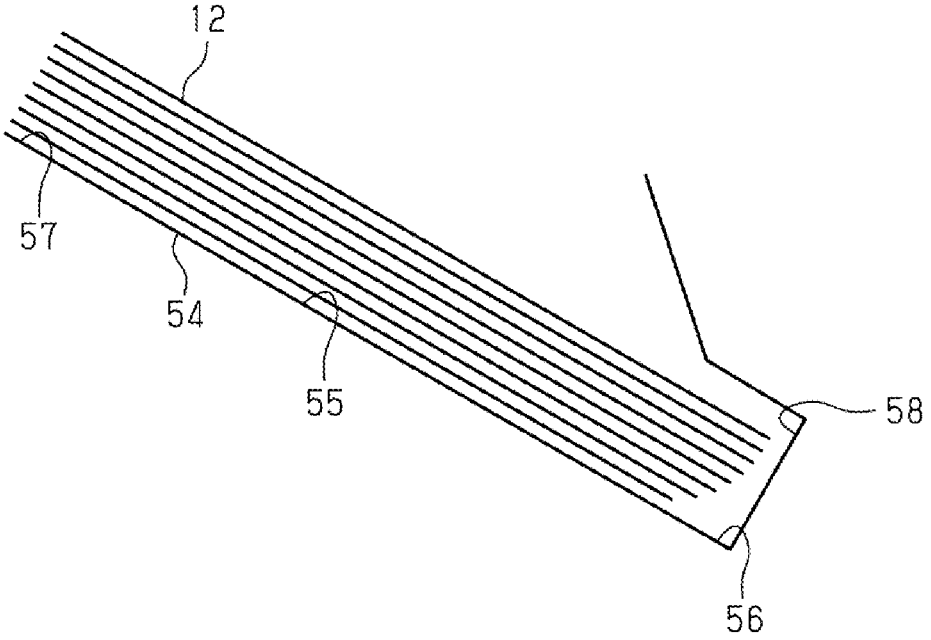
FIG. 13 is a schematic view illustrating the medium placed on the processing tray.

With this, as illustrated in FIG. 13, the placed medium 12B repeatedly moves in the opposite direction Y2, which causes alignment deviation of the medium 12 placed on the processing tray 54 in an accumulating manner.

Figure 14:
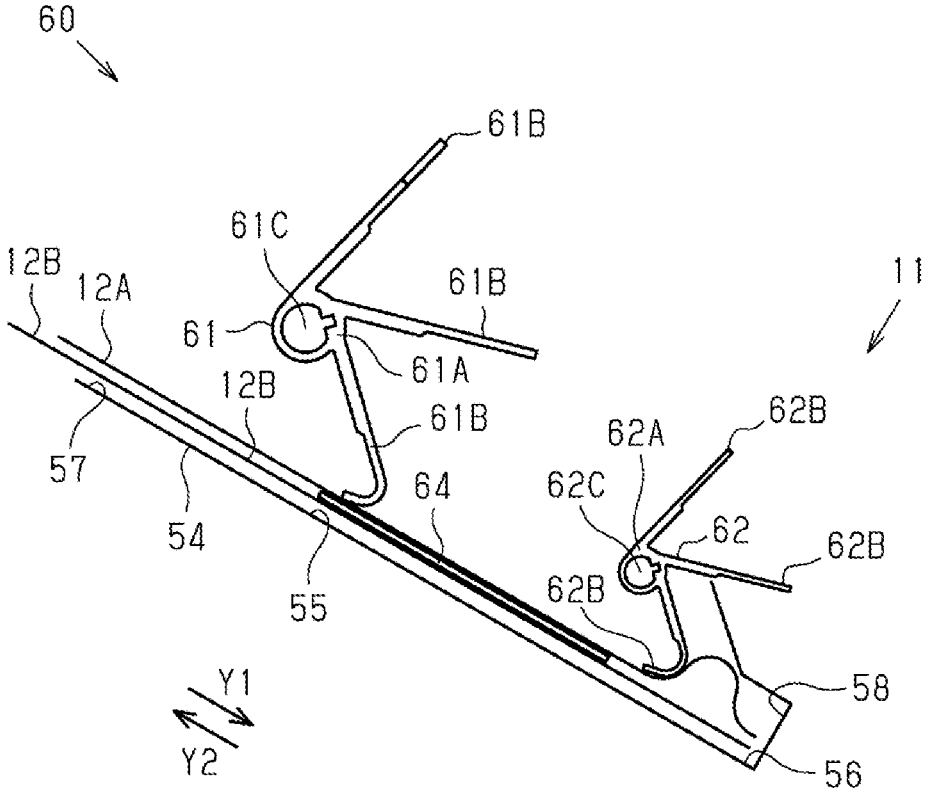
FIG. 14 is a schematic view illustrating the medium placed on the processing tray.

Meanwhile, as illustrated in FIG. 14, as in the present exemplary embodiment, in a case in which the first alignment processing is executed, when the first blade 61B and the second blade 62B are separated away from the upper surface of the transport medium 12A, the pressing unit 64 is at the first pressing position. With this, the pressing unit 64 presses the placed medium 12B against the processing tray 54.

Figure 15:
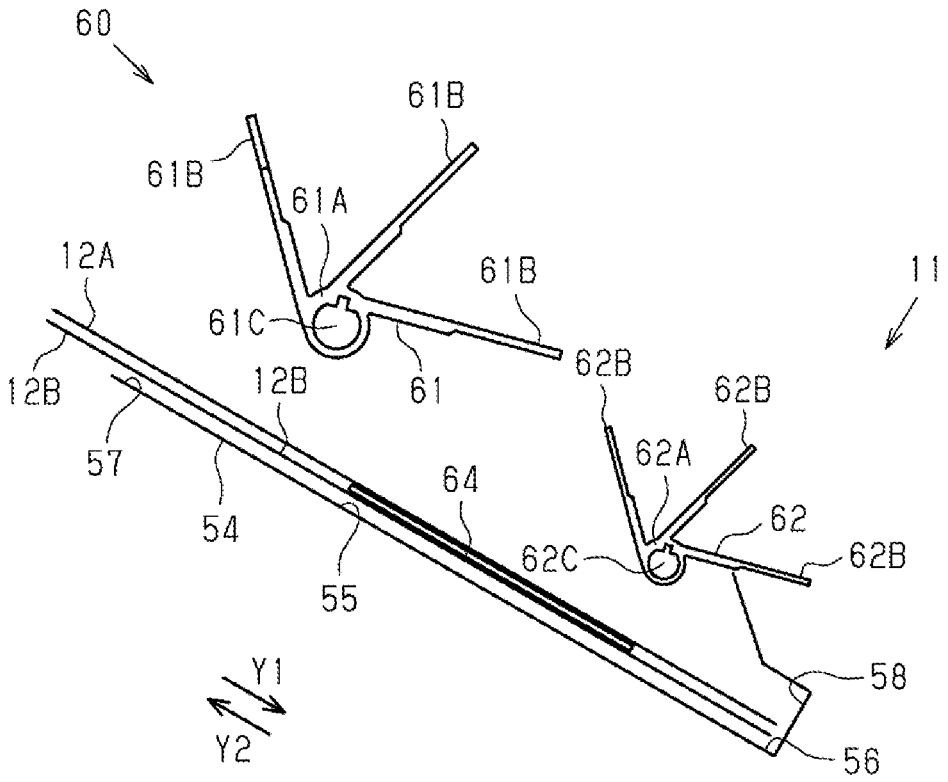
FIG. 15 is a schematic view illustrating the medium placed on the processing tray.

As illustrated in FIG. 15, when the first blade 61B and the second blade 62B are separated away from the upper surface of the transport medium 12A, warpage of the transport medium 12A is released. In this case, even when a restoring force for canceling warpage of the transport medium 12A is applied to the placed medium 12B, pressing by the pressing unit 64 prevents the placed medium 12B from moving in the opposite direction Y2.

Figure 16:
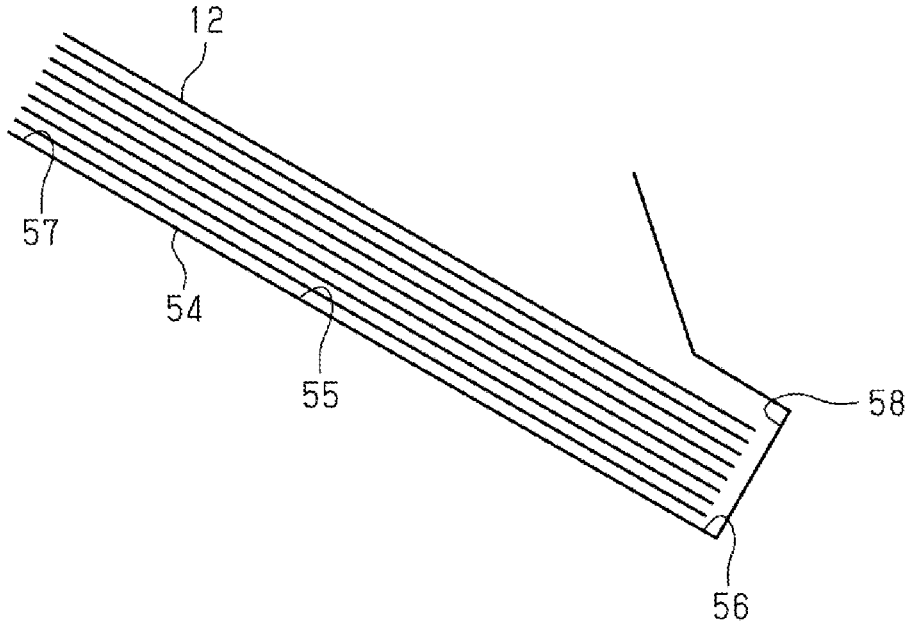
FIG. 16 is a schematic view illustrating the medium placed on the processing tray.

With this, as illustrated in FIG. 16, alignment deviation of the medium 12 placed on the processing tray 54 can be suppressed while preventing the placed medium 12B from moving in the opposite direction Y2.

In particular, a friction coefficient of the processing tray 54, a friction coefficient of the medium 12, a type of the medium 12, and the number of placed media 12B are causes for the placed medium 12B to move in the opposite direction Y2. In view of those causes, the first alignment processing for suppressing alignment deviation of the medium 12 and the second alignment processing for reducing an alignment interval are executed in a selective manner.

In a specific example, types of the medium 12 include materials, sizes, and orientations of the medium 12. Depending on a type of the medium 12, the medium 12 is curled at different degrees, and the medium 12 is warped at different degrees. Depending on a type of the medium 12, a friction coefficient and a weight of the medium 12 differ, and the placed medium 12B moves in the opposite direction Y2 at different degrees.

In particular, the uppermost placed medium 12B is more likely to move in the opposite direction Y2 when a friction coefficient of the transport medium 12A is a second friction coefficient greater than a first friction coefficient, as compared to a case in which a friction coefficient of the transport medium 12A is a first friction coefficient. Further, when a friction coefficient of the processing tray 54 is smaller than a friction coefficient of the medium 12, the lowermost placed medium 12B, which is brought into contact with the placement surface 55 of the processing tray 54, is more likely to move in the opposite direction Y2.

When a small number of placed media 12B are placed on the processing tray 54, the weight of the placed media 12B is reduced. Thus, the placed medium 12B is more likely to move in the opposite direction Y2. In contrast, a large number of placed medium 12B are placed on the processing tray 54, the weight of the placed media 12B is increased. Thus, the placed medium 12B is less likely to move in the opposite direction Y2.

Effects of First Exemplary Embodiment

Effects of the first exemplary embodiment are described.

(1) In the post-processing device in the related art, the transport medium that is newly placed on the processing tray is transported by the transport unit in the transport direction in a state in which the placed medium is already placed on the processing tray, alignment deviation is caused in some cases at the time of separating the transport unit away from the transport medium.

Specifically, the transport unit is brought into contact with the transport medium, and thus applies a transport force to the transport medium in the transport direction. Further, after the downstream end of the transport medium in the transport direction abuts against the alignment unit, a transport force is applied to the transport medium. With this, the transport medium is warped in some cases. After that, when the transport unit is separated away from the transport medium, and a transport force is not applied to the transport medium, a restoring force of the transport medium for restoring the original shape is generated in a direction opposite to the transport direction, and is applied to the placed medium in contact with the transport medium. With this, warpage of the transport medium is released. However, the placed medium in contact with the transport medium moves in a direction opposite to the transport direction due to a restoring force of the transport medium, and alignment deviation of the medium placed on the processing tray is caused in some cases.

In view of this, even when the transport medium 12A is transported by the transport unit 60 in the transport direction Y1, and thus is warped along with alignment with the first alignment unit 58, the placed medium 12B placed on the processing tray 54 is pressed against the processing tray 54. Further, after the first blade 61B and the second blade 62B are separated away from the transport medium 12A, the pressing unit 64 is movable from the first pressing position to the retraction position. With this, a restoring force of the transport medium 12A prevents the placed medium 12B from moving in the direction Y2 opposite to the transport direction Y1, and alignment deviation of the medium 12 placed on the processing tray 54 can be suppressed.

(2) Timing at which the pressing unit 64 moves from the pressing position to the retraction position can be varied, and the timing at which the pressing unit 64 moves from the pressing position to the retraction position can be switched in accordance with a situation. Therefore, in accordance with a situation, the pressing unit 64 can move from the pressing position to the retraction position at appropriate timing.

(3) Further, in a case in which the second alignment processing is executed, when the first blade 61B and the second blade 62B are separated away from the transport medium 12A, the pressing unit 64 moves from the second pressing position to the retraction position. With this, in accordance with a situation, a situation where an alignment interval between the media 12 placed on the processing tray 54 can be reduced can be generated.

(4) In a case in which a type of the medium 12 is the medium type MA or the medium type MB, when the number of placed medium 12B placed on the processing tray 54 is equal to or less than the reference number of media, the first alignment processing is executed. When the number of placed media 12B placed on the processing tray 54 is a small number, the weight of the placed media 12B placed on the processing tray 54 is smaller than that in a case in which the number is large. Thus, there is high possibility that the placed medium 12B moves in the opposite direction Y2 due to a restoring force of the transport medium 12A. In accordance with such a situation, when the first alignment processing is executed, the placed medium 12B can effectively be prevented from moving in the opposite direction Y2, and alignment deviation of the medium 12 placed on the processing tray 54 can effectively be suppressed.

(5) In a case in which a type of the medium 12 is the medium type MA or the medium type MB, when the number of placed medium 12B placed on the processing tray 54 is more than the reference number of media, the second alignment processing is executed. When the number of placed media 12B placed on the processing tray 54 is a large number, the weight of the placed media 12B placed on the processing tray 54 is greater than that in a case in which the number is small. Thus, there is low possibility that the placed medium 12B moves in the opposite direction Y2 due to a restoring force of the transport medium 12A. In accordance with such a situation, when the second alignment processing is executed, the placed medium 12B can effectively be prevented from moving in the opposite direction Y2, and alignment deviation of the medium 12 placed on the processing tray 54 can effectively be suppressed.

(6) The reference number of media can be changed to the number according to types of the medium 12, which are different in weight. Thus, the condition for executing the first alignment processing can be changed according to types of the medium 12, which are different in weight. In this manner, in accordance with a situation corresponding to a type of the medium 12, the first alignment processing is executed. With this, the placed medium 12B can effectively be prevented from moving in the opposite direction Y2, and alignment deviation of the medium 12 placed on the processing tray 54 can effectively be suppressed.

(7) When a type of the medium 12 is the medium type MC, the first alignment processing is executed. When a type of the medium 12 is the medium type MD, the second alignment processing is executed. In this manner, in accordance with a situation corresponding to a type of the medium 12, which one of the first alignment processing and the second alignment processing is executed can be selectively determined. Therefore, the placed medium 12B can effectively be prevented from moving in the opposite direction Y2, and alignment deviation of the medium 12 placed on the processing tray 54 can effectively be suppressed.

(8) A pressing force of the pressing unit 64 in the first alignment processing is stronger than that in the second alignment processing. Thus, when the first alignment processing is executed, the placed medium 12B can effectively be prevented from moving in the opposite direction Y2 in accordance with a pressing force of the pressing unit 64, and alignment deviation of the medium 12 placed on the processing tray 54 can effectively be suppressed.

(9) The pressing unit 64 is a member having a friction coefficient smaller than that of the medium 12 placed on the processing tray 54. The pressing unit 64 at the pressing position is positioned between the uppermost placed medium 12B, which is placed on the processing tray 54, and the transport medium 12A. Thus, the pressing unit 64 can press the placed medium 12B, and can improve transport performance of the transport medium 12A in the transport direction Y1. Moreover, the warped transport medium 12A is easily restored to the original shape. Therefore, the placed medium 12B can effectively be prevented from moving in the opposite direction Y2, and alignment deviation of the medium 12 placed on the processing tray 54 can effectively be suppressed.

(10) The first surfaces 81A and 82A have a friction coefficient greater than that of the second surfaces 81B and 82B. When the pressing unit 64 is at the pressing position, the first surfaces 81A and 82A are brought into contact with the uppermost placed medium 12B, which is placed on the processing tray 54, and the second surfaces 81B and 82B are brought into contact with the transport medium 12A. Thus, the pressing unit 64 can make it difficult for the placed medium 12B to move in the opposite direction Y2 due to a restoring force of the transport medium 12A, and can improve transport performance of the transport medium 12A in the transport direction Y1. Moreover, the warped transport medium 12A is easily restored to the original shape. Therefore, the placed medium 12B can effectively be prevented from moving in the opposite direction Y2 due to a restoring force of the transport medium 12A, and alignment deviation of the medium 12 placed on the processing tray 54 can effectively be suppressed.

Second Exemplary Embodiment

Next, a second exemplary embodiment is described.

In the first exemplary embodiment, the post-processing device 14 causes the pressing unit 64 to press all the placed media 12B, which are placed on the processing tray 54, against the processing tray 54. In the second exemplary embodiment, the post-processing device 14 may cause the pressing unit 64 to press the lowermost placed medium 12B of all the placed media 12B, which are placed on the processing tray 54, against the processing tray 54. In the following description, configurations and control contents identical to those in the exemplary embodiment described above are denoted by the same reference symbols, and redundant description therefor is omitted.

Figure 17:
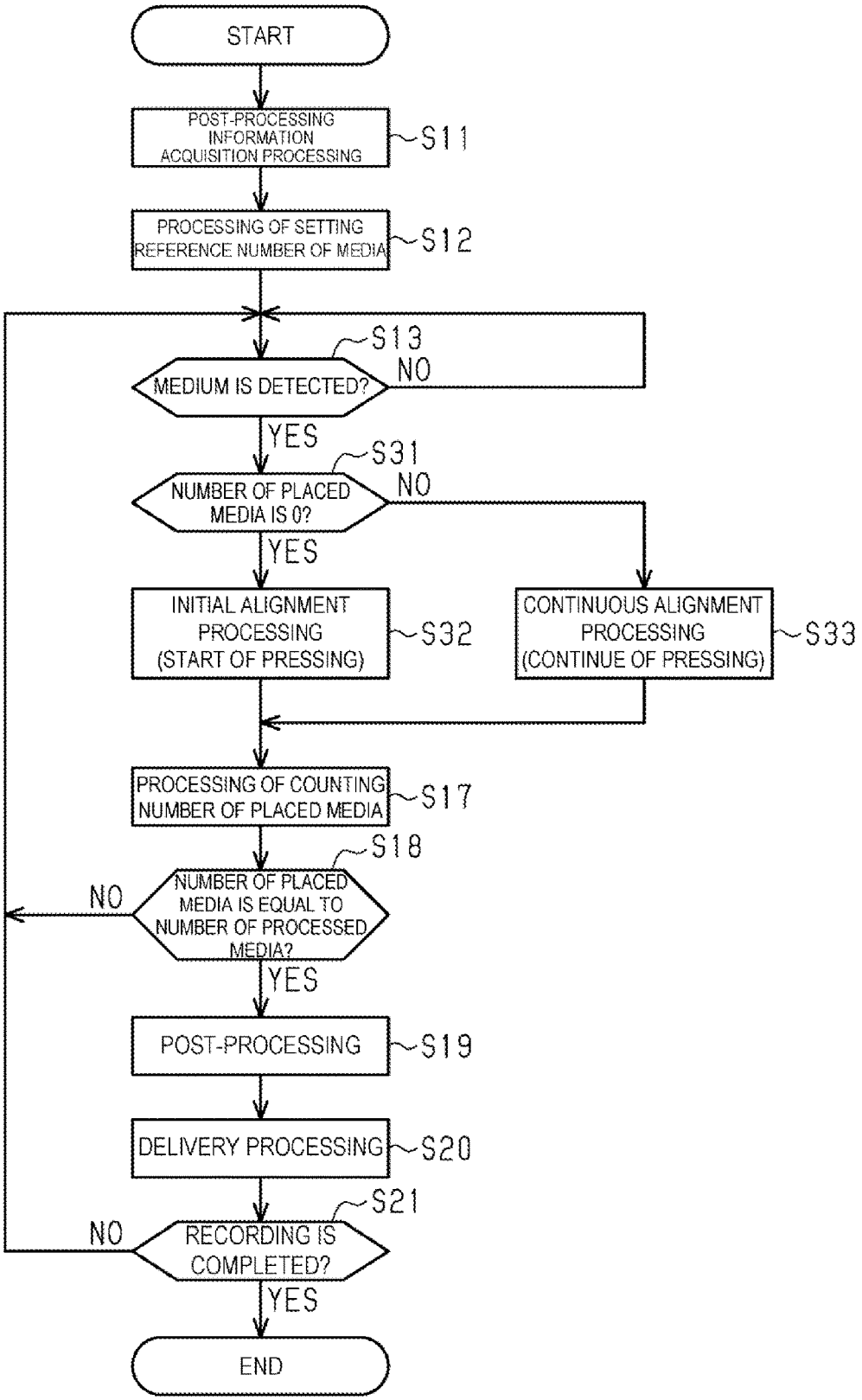
FIG. 17 is a flowchart illustrating the alignment control processing.

As illustrated in FIG. 17, in the alignment control processing, when Step S11 is terminated, the post-processing control unit 80 proceeds to Step S13. In Step S13, when it is determined that the trailing end of the medium 12 is detected, the post-processing control unit 80 proceeds to Step S31.

In Step S31, the post-processing control unit 80 determines whether the number of placed media 12B placed on the processing tray 54 is zero. In this processing, the post-processing control unit 80 reads out a value from the placed-medium counter, and specifies the number of placed media 12B. With this, the post-processing control unit 80 is capable of determining whether the number of placed media 12B is zero. In other words, when the number of placed media 12B is zero, and the trailing end of the medium 12 is detected, the post-processing control unit 80 determines whether the medium 12 is the first medium 12 to be placed on the processing tray 54.

When it is determined that the number of placed media 12B is zero, the post-processing control unit 80 proceeds to Step S32. When it is determined that the number of placed media 12B is not zero, the post-processing control unit 80 proceeds to Step S33.

In Step S32, the post-processing control unit 80 executes initial alignment processing. In this processing, similarly to the first alignment processing of the first exemplary embodiment, the post-processing control unit 80 executes the transport processing and the first pressing processing.

In particular, in this case, the transport medium 12A is newly placed as an uppermost medium in a state in which the placed medium 12B is not placed on the processing tray 54. Further, when the time period t21 elapses from detection of the trailing end of the transport medium 12A, the pressing unit 64 is at the retraction position, and does not move from the retraction position. After that, when the time period t24 elapses, the post-processing control unit 80 causes the pressing unit 64 to move from the retraction position to the first pressing position. With this, the post-processing control unit 80 causes the pressing unit 64 to press the upper surface of the first placed medium 12B, which is placed on the processing tray 54, against the processing tray 54. When Step S32 is terminated, the post-processing control unit 80 proceeds to Step S17.

In Step S33, the post-processing control unit 80 executes continuous alignment processing. In this processing, the post-processing control unit 80 executes the transport processing, which is similar to the first alignment processing in the first exemplary embodiment, and does not execute the first pressing processing, which is different from the first alignment processing in the first exemplary embodiment. Specifically, even when the plurality of placed media 12B are placed on the processing tray 54, the post-processing control unit 80 causes the pressing unit 64 to continue pressing the upper surface of the first placed medium 12B. When Step S32 is terminated, the post-processing control unit 80 proceeds to Step S17.

In this manner, the post-processing control unit 80 causes the pressing unit 64 to press the first placed medium 12B placed on the processing tray 54, and causes the pressing unit 64 to continue the pressing until predetermined time after execution of the post-processing.

Operations of Second Exemplary Embodiment

Operations of the second exemplary embodiment are described.

When the placed medium 12B is not placed on the processing tray 54, the pressing unit 64 is at the retraction position. The transport medium 12A is newly placed as an uppermost medium in a state in which the placed medium 12B is not placed on the processing tray 54. The transport unit 60 transports the transport medium 12A in the transport direction Y1. As a result, the trailing end of the transport medium 12A abuts against the first alignment unit 58. Further, in a certain situation, the transport medium 12A is warped due to a transport force of the transport unit 60 in some cases. However, the placed medium 12B is not placed on the processing tray 54, and hence alignment deviation is not caused.

After that, the first blade 61B and the second blade 62B are separated away from the upper surface of the transport medium 12A. Then, the pressing unit 64 moves from the retraction position to the first pressing position, and presses the first placed medium 12B against the processing tray 54.

Next, when the placed medium 12B is placed on the processing tray 54, the pressing unit 64 is continuously at the first pressing position, and the pressing unit 64 presses the first placed medium 12B against the processing tray 54. Further, the pressing unit 64 does not press the second placed medium 12B and a medium thereafter against the processing tray 54.

A friction coefficient of the processing tray 54 is smaller than a friction coefficient of the placed medium 12B. The first placed medium 12B placed on the processing tray 54 is more likely to move in the opposite direction Y2, as compared to the second placed medium 12B and a medium thereafter. Thus, when the first placed medium 12B placed on the processing tray 54 does not move in the opposite direction Y2, all the placed media 12B do not move in the opposite direction Y2. Thus, alignment deviation of the medium 12 placed on the processing tray 54 can be suppressed.

Effects of Second Exemplary Embodiment

Effects of the second exemplary embodiment are described.

(11) The processing tray 54 is a member having a friction coefficient smaller than that of the medium 12 placed on the processing tray 54. The first placed medium 12B placed on the processing tray 54 is pressed, and the pressing continues until predetermined time after execution of the post-processing. The first placed medium 12B in contact with the processing tray 54, which has a friction coefficient smaller than that of the medium 12, is more likely to move in the opposite direction Y2 due to a restoring force of the transport medium 12A, as compared to the second placed medium 12B and a medium thereafter that are not brought into contact with the processing tray 54. Thus, the first placed medium 12B can be prevented from moving in the opposite direction Y2 due to a restoring force of the transport medium 12A, and alignment deviation of the medium 12 placed on the processing tray 54 can effectively be suppressed.

Modified Examples

The present exemplary embodiments described above may be modified as follows. The present exemplary embodiments and modified examples thereof to be described below may be implemented in combination within a range in which a technical contradiction does not arise.

In the first exemplary embodiment, in the second alignment processing, the post-processing control unit 80 may cause the pressing unit 64 to move from the second pressing position to the retraction position before the transport unit 60 is separated away from the transport medium 12A.

In the second exemplary embodiment, the predetermined timing may be freely-selected timing. For example, the post-processing control unit 80 may cause the pressing unit 64 to press the first placed medium 12B, and may cause the pressing unit 64 to continue pressing on the first placed medium 12B until predetermined timing at which the number of placed media 12B reaches the predetermined number of media arrives. In this case, the predetermined number is only required to be two or more.

The transport unit 60 may be brought into contact with and be separated away from the transport medium 12A in a repeating manner during a period in which one transport medium 12A is aligned. Further, the first blade 61B and the second blade 62B may be brought into contact with and be separated away from the transport medium 12A in a repeating manner while the first paddle 61 and the second paddle 62 make one rotation. In a specific example, in FIG. 8, while the time period t14 elapses from the timing indicated with the reference symbol T4, the first blade 61B and the second blade 62B may be brought into contact with the upper surface of the transport medium 12A for a plurality of times, and may be separated away from the upper surface of the transport medium 12A for a plurality of times. In this case, the pressing unit 64 preferably presses all the placed media 12B placed on the processing tray 54 during a period in which one transport medium 12A is aligned, and preferably moves from the pressing position to the retraction position after the last separation among the plurality of separations made by the transport unit 60.

The first paddle 61 and the second paddle 62 may be capable of adjusting a distance to the processing tray 54. In this case, the post-processing control unit 80 may cause the first paddle 61 and the second paddle 62 to move between a contact position for enabling contact with the transport medium 12A placed on the processing tray 54 and a separation position for preventing contact with the transport medium 12A placed on the processing tray 54.

The transport unit 60 may include one, or three or more paddles.

The pressing unit 64 may be configured to adjust a distance to the processing tray 54. The post-processing control unit 80 may change a pressing force of pressing the placed medium 12B by adjusting the distance between the pressing unit 64 and the processing tray 54. In this case, as the pressing position of the pressing unit 64, only any one of the first pressing position and the second pressing position may be adopted.

The pressing unit 64 is movable between the pressing position and the retraction position by rotation, but is not limited thereto. For example, the pressing unit 64 may be movable between the pressing position and the retraction position by moving in the width direction X.

The pressing unit 64 may press the placed medium 12B with the same pressing force in the first alignment processing and the second alignment processing.

The pressing unit 64 may be formed of one, or three or more members.

When the number of placed media 12B placed on the processing tray 54 is greater than the reference number of media, the post-processing control unit 80 is not required to cause the pressing unit 64 to press the upper surface of the placed medium 12B. In this case, when the number of placed media 12B placed on the processing tray 54 is greater than the reference number of media, the post-processing control unit 80 may cause the pressing unit 64 to press the upper surface of the reference number of placed media 12B placed on the processing tray 54. In a specific example, the reference number of media is six, the post-processing control unit 80 may cause the pressing unit 64 to press the upper surface of the uppermost placed medium 12B of the first to sixth placed media 12B. Further, the post-processing control unit 80 may not cause the pressing unit 64 to press the seventh placed medium 12B and a medium thereafter, and may cause the pressing unit 64 to continue pressing the upper surface of the sixth placed medium 12B or may cause the pressing unit 64 to move to the retraction position.

Regardless of the reference number of media, the first alignment processing may be executed for different types of the medium instead of the second alignment processing.

Regardless of the reference number of media, the second alignment processing may be executed for different types of the medium instead of the first alignment processing. The same reference number of media may be determined for different types of the medium.

At least any one of the medium type MA to the medium type MD may not be included in types of the medium 12. Further, types of the medium 12 may be types with at least one of different weights and different fiber directions.

The post-processing device 14 and the intermediate device 15 may be combined as the post-processing device. The post-processing device 14 may receive the medium 12 after recording from the recording device 13 instead of the intermediate device 15.

The medium 12 is not limited to paper and may be a film made of a synthetic resin, a cloth, a non-woven fabric, a laminated medium, or the like.

Liquid can be freely selected as long as it can be recorded on the medium 12 by adhering to the medium 12. For example, an ink includes various compositions such as an aqueous ink, an oil-based ink, a gel ink, a hot melt ink, or the like, including particles of a functional material made of a solid such as pigments or metal particles dissolved, dispersed or mixed in a solvent.

The recording device 13 is not limited to a printer, and may be a printing apparatus. Further, the recording device 13 may be a composite having a scanner mechanism and a copy function in addition to the recording function.

Supplementary Note

Hereinafter, technical concepts and effects thereof that are understood from the above-described exemplary embodiments and modified examples are described.

(A) A post-processing device includes a processing tray configured to place a medium after recording thereon, a transport unit configured to transport, in a transport direction, an upper most medium placed on the processing tray by contacting with an upper surface of the upper most medium placed on the processing tray, an alignment unit configured to align a downstream end, in the transport direction, of the medium placed on the processing tray, a pressing unit configured to press, against the processing tray, the medium placed on the processing tray, and a control unit configured to control an operation of the pressing unit, wherein the pressing unit is configured to move between a pressing position at which the medium placed on the processing tray is pressed and a retraction position at which pressing on the medium placed on the processing tray is released, the control unit is configured to, when the transport unit transports a transport medium after the transport medium is newly placed as an uppermost medium in a state in which one or a plurality of placed media are already placed on the processing tray, cause the pressing unit at the pressing position to press at least one of the placed media placed on the processing tray, and the control unit is configured to, after the transport unit is separated away from the transport medium, move the pressing unit from the pressing position to the retraction position.

According to this configuration, even when the transport medium is warped along transport by the transport unit in the transport direction, at least one placed medium placed on the processing tray is pressed against the processing tray. Further, after the transport unit is separated away from the transport medium, the pressing unit is movable from the pressing position to the retraction position. With this, a restoring force of the transport medium can prevent the placed medium from moving in the direction opposite to the transport direction, and alignment deviation of the medium placed on the processing tray can be suppressed.

(B) The control unit may be configured to perform switching between first control and second control, when the transport unit transports the transport medium after the transport medium is newly placed as the uppermost medium in the state in which the one or plurality of placed media are already placed on the processing tray, the first control being for moving the pressing unit from the pressing position to the retraction position after the transport unit is separated from a transport medium, and the second control being for moving the pressing unit from the pressing position to the retraction position before the transport unit is separated from the transport medium or when the transport unit is separated from the transport medium.

According to this configuration, timing at which the pressing unit moves from the pressing position to the retraction position can be varied, and the timing at which the pressing unit moves from the pressing position to the retraction position can be switched in accordance with a situation. Therefore, in accordance with a situation, the pressing unit can move from the pressing position to the retraction position at appropriate timing.

(C) The control unit may be configured to execute the first control when the number of placed media placed on the processing tray is equal to or less than a reference number of media.

According to this configuration, when the number of placed media placed on the processing tray is equal to or less than the reference number of media, the first control is executed. When the number of placed media placed on the processing tray is a small number, the weight of the placed media placed on the processing tray is smaller than that in a case in which the number is large. Thus, there is high possibility that the placed medium moves in the direction opposite to the transport direction due to a restoring force of the transport medium. In accordance with such a situation, the first control is executed. With this, a restoring force of the transport medium can effectively prevent the placed medium from moving in the direction opposite to the transport direction, and alignment deviation of the medium placed on the processing tray can effectively be suppressed.

(D) The control unit may be configured to execute the second control when the number of placed media placed on the processing tray is more than the reference number of media.

According to this configuration, when the number of placed media placed on the processing tray is more than the reference number of media, the second control is executed. When the number of placed media placed on the processing tray is a large number, the weight of the placed media placed on the processing tray is greater than that in a case in which the number is small. Thus, there is low possibility that the placed medium moves in the direction opposite to the transport direction due to a restoring force of the transport medium. In accordance with such a situation, the second control is executed. With this, a restoring force of the transport medium can effectively prevent the placed medium from moving in the direction opposite to the transport direction, and alignment deviation of the medium placed on the processing tray can effectively be suppressed.

(E) The control unit may be configured to change the reference number of media in accordance with medium types different in weight.

According to this configuration, the reference number of media can be changed to the number according to medium types different in weight. Thus, the condition for executing the first control can be changed according to medium types different in weight. In this manner, in accordance with a situation corresponding to a medium type, the first control is executed. With this, a restoring force of the transport medium can effectively prevent the placed medium from moving in the direction opposite to the transport direction, and alignment deviation of the medium placed on the processing tray can effectively be suppressed.

(F) The control unit may be configured to execute any one of the first control and the second control in accordance with medium types.

According to this configuration, any one of the first control and the second control is executed according to a medium type. In this manner, in accordance with a situation corresponding to a medium type, which one of the first control and the second control is executed can be selectively determined. Therefore, a restoring force of the transport medium can effectively prevent the placed medium from moving in the direction opposite to the transport direction, and alignment deviation of the medium placed on the processing tray can effectively be suppressed.

(G) The processing tray may be a member having a friction coefficient smaller than a friction coefficient of the medium placed on the processing tray, and the control unit may cause the pressing unit to press a first placed medium placed on the processing tray, and continues pressing by the pressing unit until predetermined time.

According to this configuration, the processing tray is a member having a friction coefficient smaller than that of the medium placed on the processing tray. The first placed medium placed on the processing tray is pressed, and the pressing continues until predetermined time. The first placed medium in contact with the processing tray, which has a friction coefficient smaller than that of the medium, is more likely to move in the direction opposite to the transport direction due to a restoring force of the transport medium, as compared to the second placed medium and a medium thereafter that are not brought into contact with the processing tray. Thus, the first placed medium can be prevented from moving in the direction opposite to the transport direction due to a restoring force of the transport medium, and alignment deviation of the medium placed on the processing tray can effectively be suppressed.

(H) The control unit may be configured to change a pressing force of the pressing unit, and the control unit may be configured to cause a pressing force of the pressing unit in the first control to be stronger than in the second control.

According to this configuration, a pressing force of the pressing unit in the first control is stronger than that in the second control. Thus, when the first control is executed, a restoring force of the transport medium can effectively prevent the placed medium from moving in the direction opposite to the transport direction according to a pressing force of the pressing unit, and alignment deviation of the medium placed on the processing tray can effectively be suppressed.

(I) The pressing unit may be a member having a friction coefficient smaller than a friction coefficient of the medium placed on the processing tray, and when the transport unit transports the transport medium after the transport medium is newly placed as the uppermost medium in the state in which the one or a plurality of placed media are already placed on the processing tray, the pressing unit at the pressing position may be positioned between the uppermost placed medium placed on the processing tray and the transport medium.

According to this configuration, the pressing unit is a member having a friction coefficient smaller than that of the medium placed on the processing tray. When the pressing unit is at the pressing position, the pressing unit is positioned between the uppermost placed medium placed on the processing tray and the transport medium. Thus, the pressing unit can press the placed medium, and can improve transport performance of the transport medium in the transport direction. Moreover, the warped transport medium is easily restored to the original shape. Therefore, a restoring force of the transport medium can effectively prevent the placed medium from moving in the direction opposite to the transport direction, and alignment deviation of the medium placed on the processing tray can effectively be suppressed.

(J) The pressing unit may have a sheet-like shape with a first surface and a second surface, the first surface may have a friction coefficient greater than a friction coefficient of the second surface, and when the transport unit transports the transport medium after the transport medium is newly placed as the uppermost medium in the state in which the one or plurality of placed media are already placed on the processing tray, the pressing unit at the pressing position may be is brought into contact, at the first surface, with the uppermost placed medium placed on the processing tray and is brought into contact, at the second surface, with the transport medium.

According to this configuration, when the first surface has a friction coefficient greater than that of the second surface, and the pressing unit is at the pressing position, the first surface is brought into contact with the uppermost placed medium placed on the processing tray, and the second surface is bought into contact with the transport medium. Thus, the pressing unit can make it difficult for the placed medium to move in the direction opposite to the transport direction due to a restoring force of the transport medium, and can improve transport performance of the transport medium in the transport direction. Moreover, the warped transport medium is easily restored to the original shape. Therefore, a restoring force of the transport medium can effectively prevent the placed medium from moving in the direction opposite to the transport direction, and alignment deviation of the medium placed on the processing tray can effectively be suppressed.

What is claimed is:

1. A post-processing device comprising:

a processing tray configured to place a medium after recording thereon;

a transport unit configured to transport, in a transport direction, an upper most medium placed on the processing tray by contacting with an upper surface of the upper most medium placed on the processing tray;

an alignment unit configured to align a downstream end, in the transport direction, of the medium placed on the processing tray;

a pressing unit configured to press, against the processing tray, the medium placed on the processing tray; and a control unit configured to control an operation of the pressing unit, wherein the pressing unit is configured to move between a pressing position at which the medium placed on the processing tray is pressed and a retraction position at which pressing on the medium placed on the processing tray is released, the control unit is configured to, when the transport unit transports a transport medium after the transport medium is newly placed as an uppermost medium in a state in which one or a plurality of placed media are already placed on the processing tray, cause the pressing unit at the pressing position to press at least one of the placed media placed on the processing tray, the control unit is configured to perform switching between first control and second control, when the transport unit transports the transport medium after the transport medium is newly placed as the uppermost medium in the state in which the one or plurality of placed media are already placed on the processing tray, the first control being for moving the pressing unit from the pressing position to the retraction position after the transport unit is separated from a transport medium, and the second control being for moving the pressing unit from the pressing position to the retraction position before the transport unit is separated from the transport medium or when the transport unit is separated from the transport medium.

2. The post-processing device according to claim 1, wherein the control unit is configured to execute the first control when the number of placed media placed on the processing tray is equal to or less than a reference number of media.

3. The post-processing device according to claim 2, wherein the control unit is configured to execute the second control when the number of placed media placed on the processing tray is more than the reference number of media.

4. The post-processing device according to claim 2, wherein the control unit is configured to change the reference number of media in accordance with medium types different in weight.

5. The post-processing device according to claim 1, wherein the control unit is configured to execute any one of the first control and the second control in accordance with medium types.

6. The post-processing device according to claim 1, wherein the control unit is configured to change a pressing force of the pressing unit, and the control unit is configured to cause a pressing force of the pressing unit in the first control to be stronger than in the second control.

7. The post-processing device according to claim 1, wherein the pressing unit is a member having a friction coefficient smaller than a friction coefficient of the medium placed on the processing tray, and when the transport unit transports the transport medium after the transport medium is newly placed as the uppermost medium in the state in which the one or a plurality of placed media are already placed on the processing tray, the pressing unit at the pressing position is positioned between the uppermost placed medium placed on the processing tray and the transport medium.

8. The post-processing device according to claim 7, wherein the pressing unit has a first surface and a second surface, the first surface has a friction coefficient greater than a friction coefficient of the second surface, and when the transport unit transports the transport medium after the transport medium is newly placed as the uppermost medium in the state in which the one or plurality of placed media are already placed on the processing tray, the pressing unit at the pressing position is brought into contact, at the first surface, with the uppermost placed medium placed on the processing tray and is brought into contact, at the second surface, with the transport medium.

9. A recording system comprising:

a recording device configured to perform recording on a medium; and a post-processing device according to claim 1, the post-processing device being configured to perform post-processing on the medium after recording is performed thereon by the recording device.

10. A post-processing device comprising:

a processing tray configured to place a medium after recording thereon;

a transport unit configured to transport, in a transport direction, an upper most medium placed on the processing tray by contacting with an upper surface of the upper most medium placed on the processing tray;

an alignment unit configured to align a downstream end, in the transport direction, of the medium placed on the processing tray;

a pressing unit configured to press, against the processing tray, the medium placed on the processing tray; and a control unit configured to control an operation of the pressing unit, wherein the pressing unit is configured to move between a pressing position at which the medium placed on the processing tray is pressed and a retraction position at which pressing on the medium placed on the processing tray is released, the control unit is configured to, when the transport unit transports a transport medium after the transport medium is newly placed as an uppermost medium in a state in which one or a plurality of placed media are already placed on the processing tray, cause the pressing unit at the pressing position to press at least one of the placed media placed on the processing tray, the control unit is configured to, after the transport unit is separated away from the transport medium, move the pressing unit from the pressing position to the retraction position, the pressing unit is a member having a friction coefficient smaller than a friction coefficient of the medium placed on the processing tray, and the pressing unit has a first surface and a second surface, the first surface has a friction coefficient greater than a friction coefficient of the second surface, and when the transport unit transports the transport medium after the transport medium is newly placed as the uppermost medium in the state in which the one or plurality of placed media are already placed on the processing tray, the pressing unit at the pressing position is brought into contact, at the first surface, with the uppermost placed medium placed on the processing tray and is brought into contact, at the second surface, with the transport medium.

11. The post-processing device according to claim 10, wherein the processing tray is a member having a friction coefficient smaller than a friction coefficient of the medium placed on the processing tray, and the control unit causes the pressing unit to press a first placed medium placed on the processing tray, and continues pressing by the pressing unit until predetermined time.

12. A recording system comprising:

a recording device configured to perform recording on a medium; and a post-processing device according to claim 10, the post-processing device being configured to perform post-processing on the medium after recording is performed thereon by the recording device.

* * * * *